US007302197B2

(12) United States Patent
Kosuge

(10) Patent No.: US 7,302,197 B2
(45) Date of Patent: Nov. 27, 2007

(54) IMAGE FORMING APPARATUS HAVING A DETACHABLE PROCESS CARTRIDGE AND A LUBRICANT

(75) Inventor: Akio Kosuge, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 18 days.

(21) Appl. No.: 10/923,904

(22) Filed: Aug. 24, 2004

(65) Prior Publication Data

US 2005/0047804 A1 Mar. 3, 2005

(30) Foreign Application Priority Data

Aug. 29, 2003 (JP) ..... 2003-307090
Oct. 20, 2003 (JP) ..... 2003-358850
Oct. 31, 2003 (JP) ..... 2003-373030

(51) Int. Cl.
*G03G 15/08* (2006.01)
*G03G 15/00* (2006.01)

(52) U.S. Cl. ..... 399/27; 399/159

(58) Field of Classification Search ..... 399/346, 399/27, 159, 222, 252
See application file for complete search history.

(56) References Cited

U.S. PATENT DOCUMENTS 4,663,259 A 5/1987 Fujimura et al.
5,321,482 A * 6/1994 Yano et al. ..... 399/346
6,060,205 A 5/2000 Takeichi et al.
6,163,669 A 12/2000 Aoki et al.
6,295,437 B1 * 9/2001 Hodoshima et al. ..... 399/346
6,363,237 B1 3/2002 Nagame et al.
6,560,438 B2 5/2003 Kosuge
6,562,529 B1 5/2003 Kojima et al.
6,576,388 B2 6/2003 Sakon et al.
6,768,879 B2 7/2004 Kosuge
6,775,511 B2 8/2004 Kosuge
2003/0049555 A1 3/2003 Sakon et al.
2003/0138711 A1 * 7/2003 Kabata et al. ..... 430/56
2003/0152859 A1 * 8/2003 Emoto et al. ..... 430/109.4
2003/0190539 A1 * 10/2003 Niimi ..... 430/58.7
2004/0081477 A1 * 4/2004 Maebashi et al. ..... 399/49
2004/0146316 A1 * 7/2004 Yamada et al. ..... 399/227

FOREIGN PATENT DOCUMENTS

JP 8-234642 9/1996
JP 8-314236 11/1996
JP 11-202569 7/1999
JP 11-212372 8/1999
JP 2000-19858 1/2000

(Continued)

*Primary Examiner*—Quana Grainger
(74) *Attorney, Agent, or Firm*—Oblon, Spivak, McClelland, Maier & Neustadt, P.C.

(57) ABSTRACT

An image forming apparatus including at least one image bearing member; at least one charging device configured to charge a surface of the at least one image bearing member; and at least one developing device configured to develop an electrostatic latent image on the surface of the at least one image bearing member with a developer including a toner to form a toner image thereon, wherein the surface of the image bearing member has a friction coefficient of from 0.10 to 0.30. The image forming apparatus can include a lubricant applicator configured to apply a lubricant to the image bearing member. Alternatively, the outermost layer of the image bearing member can include a lubricant.

18 Claims, 8 Drawing Sheets

FOREIGN PATENT DOCUMENTS

| | | | | |
|---|---|---|---|---|
| JP | 2000-122434 | | | 4/2000 |
| JP | 2001-109235 | | | 4/2001 |
| JP | 2002-49193 | | | 2/2002 |
| JP | 2002-148876 | | | 5/2002 |
| JP | 2002169444 | A | * | 6/2002 |
| JP | 2002-287567 | | | 10/2002 |
| JP | 2002-341695 | | | 11/2002 |
| JP | 2003098711 | A | * | 4/2003 |
| JP | 2004021109 | A | * | 1/2004 |
| JP | 2004-37516 | | | 2/2004 |
| JP | 2004-69738 | | | 3/2004 |

* cited by examiner

IMAGE FORMING APPARATUS HAVING A DETACHABLE PROCESS CARTRIDGE AND A LUBRICANT

BACKGROUND OF THE INVENTION

1. Field of the Invention

The present invention relates to an image forming apparatus, and a process cartridge which can be detachably set in the image forming apparatus.

2. Discussion of the Background

Electrophotographic image forming apparatus including a photoreceptor serving as an image bearing member, a charging roller which serves as a charging device and uniformly charges the photoreceptor, a light irradiator which irradiates the photoreceptor with imagewise light to form an electrostatic latent image, and a developing device which develops the electrostatic latent image with a toner to form a toner image on the photoreceptor are well known. The image forming apparatus also include a transfer device which transfer the toner image onto a receiving material or a transfer belt, and a cleaning device which removes toner particles remaining on the photoreceptor even after the toner image transfer operation.

As to the photoreceptor for use in the image forming apparatus, organic photoreceptors are typically used therefor because of having low cost and high productivity and being pollution free. However, organic photoreceptors have low abrasion resistance, i.e., have a relatively low abrasion resistance compared to inorganic photoreceptors. In attempting to improve the abrasion resistance, photoreceptors including a metal oxide in the outermost layer thereof have been proposed.

In addition, in attempting to fulfill a recent need for high quality images, toners having a small particle diameter and/or a spherical form have been proposed and popularly used. However, in an image forming apparatus using such a spherical toner with a small particle diameter, toner particles remaining on the photoreceptor cannot be well removed with a cleaner such as brush rollers and cleaning blades. The toner particles thus remaining on the photoreceptor without being removed are adhered to the charging roller used, thereby causing uneven charging and deteriorating image qualities of the resultant images.

Published unexamined Japanese Patent Application No. (hereinafter referred to as JP-A) 2001-109235 discloses a short-range charger in which a charging roller is arranged so as to be close to a photoreceptor while having a predetermined gap. It is described therein that by using the short-range charger, the amount of toner particles adhered to the charging roller can be reduced, resulting in prevention of occurrence of the uneven charging problem. In addition, JP-A 2001-109235 discloses to apply a DC voltage overlapped with an AC voltage to the charging roller (hereinafter this charging method is referred to as AC roller charging), to avoid uneven charging due to variation of the gap between the charging roller and the photoreceptor.

However, when the AC roller charging is performed, the amount of materials generated by high-energy discharging caused in the vicinity of the photoreceptor, such as ozone, is relatively large compared with those in the case where a contact charging roller to which a DC voltage is applied is used. The discharge-induced materials change the properties of the surface of the photoreceptors used, resulting in increase in friction coefficient of the surface of the photoreceptors. Since a photoreceptor including a metal oxide in the outermost layer thereof has a good abrasion resistance, the surface of the photoreceptor is hardly abraded, and therefore the properties of the surface are further changed, resulting remarkable increase in the friction coefficient of the photoreceptors. When the friction coefficient of the surface of photoreceptors increases, a problem in that a toner image is not well transferred to a receiving material tends to occur. Particularly, when the surface of the receiving material is smooth, this transfer problem is more frequently caused.

Image forming apparatus having a lubricant applicator which applies a lubricant to the image bearing members thereof have been proposed. The image forming apparatus have advantages such that the abraded amount of the surface of the image bearing members is reduced; the toner transfer rate is improved; formation of undesired images such as images with omissions can be prevented; and the cleanability of the image bearing members is improved.

In a case where a lubricant is supplied by a solid lubricant stick, the lubricant stick is abraded as the image forming apparatus are used and it is difficult to maintain lubricant application conditions for a long period of time.

In attempting to solve this problem, JP-As 08-234642 and 11-202569 have disclosed techniques in that the amount of toner adhered to an image bearing member is checked using a toner amount detector to determine the conditions of the lubricant adhered to the image bearing member and to maintain the surface conditions of the image bearing member.

In addition, JP-As 08-234642 and 2002-341695 have disclosed techniques in that the pressure applied to a lubricant applicator is changed or the number of rotations or rotation cycle of the lubricant applicator are changed, depending on the amount of fed papers to control the coating amount of the lubricant so as to be uniform even when the lubricant stick is abraded with time.

As mentioned above, toners having a small particle diameter have been popularly used, but such small toners have poor cleanability. By applying a lubricant to the surface of an image bearing member, the cleanability of the image bearing member can be improved. However, the conditions of the lubricant adhered to the image bearing member cannot be satisfactorily maintained.

For example, the method in which the conditions of the lubricant on the surface of an image bearing member is determined by checking the amount of the toner adhered to the image bearing member using a toner amount detector has a drawback in that the conditions determined do not necessarily represent the conditions of the entire surface of the image bearing member because the detector measures the toner amount of only a part of toner images. In recent years, compact high speed full color image forming apparatuses including tandem type image forming units have been practically used. When a toner amount detector is provided on each of the tandem type image forming units, the image forming apparatus have high cost and become large in size.

There is another method in which the lubricant application conditions are controlled depending on the image area proportion. However, when, for example, 100 copies of an image are reproduced, the rotation number of the image bearing member is largely different between a case where the copies are produced one by one and a case where the copies are continuously produced. Therefore, the conditions of the image bearing member do not necessarily correspond to the image area proportion of the produced images.

Because of these reasons, a need exists for an image forming apparatus which can stably produce high quality images without causing the charging problem and the transfer problem mentioned above even when using a photoreceptor with good abrasion resistance.

SUMMARY OF THE INVENTION

Accordingly, an object of the present invention is to provide an image forming apparatus and a process cartridge therefor, which use a photoreceptor with good abrasion resistance and which can produce high quality images without causing the charging problem and the transfer problem mentioned above.

Briefly this object and other objects of the present invention as hereinafter will become more readily apparent can be attained by an image forming apparatus including at least one image bearing member, at least one charging device configured to charge a surface of the image bearing member, and at least one developing device configured to develop an electrostatic latent image on the surface of the image bearing member to form a toner image thereon, wherein the surface of the image bearing member has a coefficient of static friction (hereinafter referred to as friction coefficient) of from 0.10 to 0.30.

The image forming apparatus preferably includes a lubricant applicator configured to apply a lubricant such as fatty acid metal salts to the surface of the image bearing member to impart such a friction coefficient thereto.

The image bearing member preferably includes a metal oxide in the outermost layer thereof in an amount of from 5 to 40% by weight based on the total weight of the outermost layer. The thickness of the outermost layer is preferably from 3 to 8 μm.

The image forming apparatus can further include a toner image transporter (such as intermediate transfer media and transfer belts) configured to receive and transport the toner image from the image bearing member, and a toner image detector configured to evaluate the toner image on the toner image transporter. In this case, the friction coefficient of the surface of the image bearing member is preferably not higher than that of the surface of the intermediate transfer medium. The friction coefficient of the surface of the intermediate transfer medium is preferably not higher than 0.55.

It is preferable that the toner have a volume average particle diameter (Dv) of form 3 to 7 μm; a ratio (Dv/Dn) of the volume average particle diameter (Dv) to the number average particle diameter thereof (Dn) of from 1.00 to 1.40; a form factor SF-1 of from 100 to 180; and another form factor SF-2 of from 100 to 180.

The toner is preferably prepared by a method including the steps of dissolving or dispersing toner constituents including a polyester prepolymer having a functional group including a nitrogen atom, a polyester resin, a colorant and a release agent in an organic solvent to prepare a toner constituent liquid; and dispersing the toner constituent liquid in an aqueous medium to subject the toner constituent liquid to a crosslinking reaction and/or an extending reaction.

The toner can include a lubricant such as fatty acid metal salts.

The charging device preferably charges the image bearing member by applying a DC bias with which an AC bias overlaps. The AC bias preferably has a peak-to-peak voltage (i.e., voltage between the maximum voltage and minimum voltage) not less than twice the voltage at which discharging starts to occur between the charging device and the image bearing member, and a frequency of from 7 to 12 times the linear velocity of the image bearing member. The gap between the charging device and the image bearing member is preferably from 10 to 80 μm.

It is preferable that the charging device has a charging member made of an electroconductive resin and a gap forming member which is made of an insulating material and which is provided on both sides of the charging member so as to contact the non-image portions of the image bearing member other than the image forming portion thereof to form a gap between the charging member and the image bearing member.

It is preferable that the image forming apparatus further includes a lubricant applicator configured to apply the lubricant to the image bearing member; and a lubricant application controller configured to control the lubricant applicator so as to apply the lubricant to the image bearing member at a predetermined time in which the charging device and the developing device are not operated while the image bearing member is rotated.

The image forming apparatus preferably includes a rotation detecting device configured to determine the total number of revolutions of the image bearing member; and a toner consumption detecting device configured to determine the toner consumption. When the toner consumption reaches a predetermined toner consumption before the total quantity of revolution of the at least one image bearing member is less than a predetermined quantity of revolution, the lubricant applicator applies the lubricant to the image bearing member to the image bearing member. In this regard, the quantity of revolution means, for example, total time during which the image bearing member rotates, total running distance of the image bearing member (i.e., the peripheral length×rotation number), or the like.

The image forming apparatus preferably include a bias applicator configured to apply a bias to the lubricant applicator; and a bias controller configured to control the bias application operation in such a way that the bias applied to the lubricant applicator in the image forming operation is different from that in the lubricant applying operation. For example, a bias having a polarity opposite to that of the charge of the toner is applied when the image forming operation is performed whereas a bias having an opposite polarity is applied or a bias is not applied when the lubricant application operation is performed.

When plural image bearing members are set in the image forming apparatus, plural lubricant applicators and plural lubricant application controllers corresponding to the respective image bearing members are provided. In this case, it is preferable to provide a lubricant application determining device configured to determine whether or not the lubricant application operation is performed for each image bearing member by the respective lubricant applicators.

Instead of using a technique in that a lubricant is applied to the surface of the image bearing member, a technique in that the outermost layer of the image bearing member includes a lubricant can be used for imparting friction coefficient to the surface of the image bearing member.

In this case, it is preferable that the thickness of the outermost layer is from 4 to 10 μm, and the content of a lubricant in the outermost layer is from 30 to 80% by weight based on the total weight of the outermost layer.

The lubricant is preferably a material selected from the group consisting of particulate fluorine-containing resins, particulate silicone resins and particulate polyolefin resins.

It is preferable that the area of the surface of the outermost layer occupied by the lubricant is not less than 10% based on the total area thereof, and the volume of the lubricant in the outermost layer is not less than 20% based on the total volume of the outermost layer.

As another aspect of the present invention, a process cartridge is provided which includes an image bearing member, and at least one member selected from the group consisting of a charging device, a light irradiating device, a developing device and a cleaning device, wherein the surface of the image bearing member has a friction coefficient of from 0.10 to 0.30.

It is preferable that the process cartridge includes a short-range charging device, the image bearing member includes a metal oxide in the outermost layer, and the process cartridge further includes a lubricant applicator.

When the process cartridge includes a cleaning device including a cleaning blade, the cleaning blade is set in the process cartridge without being coated with a powder when the process cartridge is shipped from a factory.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, a tandem type full color printer which is an embodiment of the image forming apparatus of the present invention will be explained referring to drawings.

Figure 1:
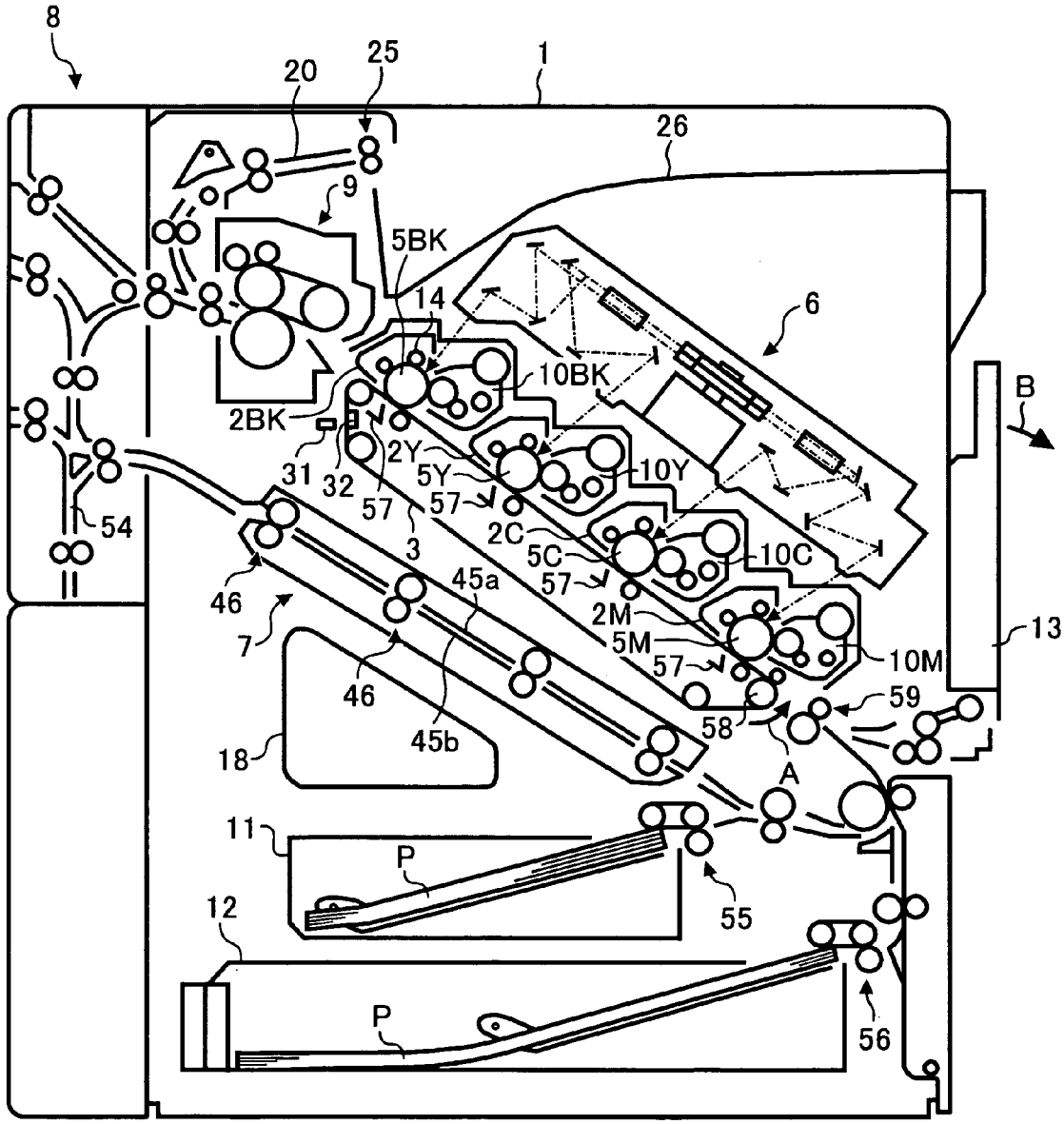
FIG. 1 is a schematic view illustrating the image forming section of a tandem type full color printer which is an embodiment of the image forming apparatus of the present invention.

FIG. 1 is an overview of the tandem type full color printer. The color printer includes a main body 1 including four photoreceptor units 2M, 2C, 2Y and 2BK, which have the same structure and each of which can be detachably set in the main body 1. Each of the units 2M, 2C, 2Y and 2BK includes a photoreceptor 5 which serves as an image bearing member. The units 2M, 2C, 2Y and 2BK respectively form magenta color images, cyan color images, yellow color images and black color images.

The main body 1 includes a transfer unit including a transfer belt 3 which is rotated in a direction A while tightly stretched with a plurality of rollers and which serves a toner image transporter. Four transfer brushes 57 are arranged inside the transfer belt 3 so as to face the respective photoreceptors. The outer surface of the transfer belt 3 contacts each of the photoreceptors 5 (5M, 5C, 5Y and 5BK).

The main body 1 includes four developing devices 10M, 10C, 10Y and 10BK which develop electrostatic latent images formed on the respective photoreceptors 5 with respective color developers to form color toner images on the respective photoreceptors 5. The developers are a two-component developer including a carrier and a color toner having a color corresponding to the color image to be produced (typically, magenta, cyan, yellow or black color).

Each of the developing devices 10 includes a developing roller 14 which faces the corresponding photoreceptor, a screw which feeds and agitates the developer, a toner concentration sensor, etc. The developing roller includes a sleeve which is rotatable, and a magnet fixedly arranged in the sleeve and configured to bear the developer on the surface of the sleeve. When the sensor sends a signal such that the toner concentration is low, the corresponding toner is replenished from a toner replenishing device (not shown).

A writing unit 6 is provided at a position above the photoreceptor units 2, and a double-sided image formation unit 7 is provided at a position below the transfer belt 3. In addition, a reverse unit 8 is provided on a left side of the main body 1, which discharges a receiving material P on which an image is formed after reversing the receiving material P or feeds the receiving material P to the double-sided image formation unit 7.

The writing unit 6 has four laser diodes which serve as light sources and which irradiate the respective photoreceptors with imagewise light to form electrostatic latent images thereon; a polygon scanner including a polygon mirror having six surfaces and a polygon motor; and a fθ lens, other lenses such as WTLs, and mirrors, which are provided in the optical path of each laser light beam. The laser light beams emitted from the laser diodes are deflected by the polygon scanner so as to irradiate the photoreceptors 5.

The double-sided image formation unit 7 includes a pair of guide plates 45*a* and 45*b*, and four pairs of feeding rollers 46. When double-sided image formation is performed, the double-sided image formation unit 7 receives the receiving material P on one side of which an image is formed and which is fed to the double-sided image formation unit 7 after switched back at a reverse transporting passage 54 of the reverse unit 8, and transports the receiving material P to the paper feeding section.

The reverse unit 8 includes plural pairs of feeding rollers, and plural pairs of feeding guides. As mentioned above, the reverse unit 8 feeds the receiving material P on which an image is formed to the double-sided image formation unit after reversing the receiving material P or discharges the receiving material P without reversing the receiving material P.

The main body 1 includes paper feeding cassettes 11 and 12, and paper separation/feed devices 55 and 56 which are provided on the paper feeding cassettes 11 and 12, respectively.

A fixing device 9 which fixes the toner images formed on the receiving material P is provided at a position between the transfer belt 3 and the reverse unit 8.

A reverse discharging passage 20 is provided on a downstream position from the fixing device 9 relative to the paper feeding direction. The reverse discharging passage 20 discharges the receiving material P to a discharge tray 26 using a pair of feeding rollers 25.

The paper feeding cassettes 11 and 12 include receiving materials having different sizes. In addition, a manual paper feeding tray 13 which can be opened in a direction indicated by an arrow B is provided on a right side of the main body 1. Manual paper feeding operation can be performed using the manual paper feeding tray 13.

Then the full color image forming operation of the full color printer will be explained.

When the full color printer receives full color image data, each of the photoreceptors 5 rotates in the clockwise direction in FIG. 1 and is uniformly charged with the corresponding charging roller 14. The writing unit 6 irradiates the photoreceptors 5 of the photoreceptor units 2M, 2C, 2Y and 2Bk with laser light beams corresponding to the respective color image data, resulting in formation of electrostatic latent images, which correspond to the respective color image data, on the photoreceptors 5. The electrostatic latent images on the photoreceptors 5 are developed with respective developers including respective color toners at the respective developing sections, resulting in formation of magenta, cyan, yellow and black toner images on the respective photoreceptors 5.

On the other hand, the receiving material (hereinafter referred to as the paper P) is fed from the paper feeding cassette 11 or 12 with the separation/feed device 55 or 56. The paper P is timely fed to the photoreceptor units 2 with a pair of registration rollers 59 so that the color toner images formed on the photoreceptors 5 are transferred to a proper position of the paper P.

The paper P is positively charged with a paper attracting roller 58 and thereby the paper P is electrostatically attracted by the surface of the transfer belt 3. The paper P is fed while attracted by the transfer belt 3 and M, C, Y and Bk toner images are sequentially transferred to the paper P, resulting in formation of a full color image in which the M, C, Y and Bk toner images are overlaid.

The full color toner image on the paper P is fixed by the fixing device 9 upon application of heat and pressure thereto. The thus prepared full color copy sheet (i.e., the paper P) is fed through the predetermined passage which changes depending on the image forming instructions. Specifically, the paper P is discharged to the discharge tray 26 in such a way that the image side faces downward, or is straightly discharged from the main body after passing through the reverse unit 8. Alternatively, when a double-sided image forming operation is ordered, the paper P is fed to the reverse feeding passage 54 and is switched back to be fed to the reverse unit 7. Then another image is formed on the other side of the paper P by the photoreceptor units 2 and the fixing device 9, and the double-sided color copy is discharged from the main body 1. When formation of two or more copies is ordered, the image forming operation mentioned above is repeated.

Then the black and white image forming operation of the full color printer will be explained.

When black and white image data are received, a driven roller facing the paper attracting roller 58 and supporting the transfer belt 3 is moved downward, thereby separating the transfer belt 3 from the photoreceptors of the photoreceptor units 2M, 2C and 2Y. The photoreceptor 5BK of the photoreceptor unit 2BK rotates in the clockwise direction in FIG. 1 to be uniformly charged with the corresponding charging roller. Then imagewise light corresponding to the black and white image data irradiates the photoreceptor 5, resulting in formation of an electrostatic latent image on the photoreceptor 5. The electrostatic latent image is developed with the black developing device 10BK, resulting in formation of a black toner image on the photoreceptor 5BK. In this case, the photoreceptor units 2M, 2C and 2Y, and the developing devices 10M, 10C and 10Y are not activated. Therefore, undesired abrasion of the photoreceptors and undesired consumption of the toners other than the black toner can be prevented.

On the other hand, the paper P is fed from the paper feeding cassette 11 or 12 with the separation/feed device 55 or 56. The paper P is timely fed to the photoreceptor unit 2BK with the pair of registration rollers 59 such that the black toner image formed on the photoreceptor 5BK is transferred to a proper position of the paper P.

The paper P is charged with the paper attracting roller 58 and thereby the paper P is electrostatically attracted by the surface of the transfer belt 3. Since the paper P is fed while attracted by the transfer belt 3, the paper P can be fed to the photoreceptor 5BK even when the photoreceptors 5M, 5C and 5Y are separated from the transfer belt 3, resulting in formation of the black color image on the paper P. After the black toner image is fixed by the fixing device 9, the copy sheet is discharged from the main body 1 according to the instructions. When two or more black copies are formed, the image forming operation is repeated.

In order to stably feed the paper P, at least the outermost layer of the transfer belt 3 is made of a material having a high resistance. Suitable materials for use as the transfer belt 3 include polyvinylidene fluoride resins, polyimide resins, polycarbonate resins, polyethylene terephthalate resins, etc. An electroconductive material such as carbon blacks can be included in the transfer belt 3 to control the resistance thereof. In addition, a layer can be formed on the surface of the base film using a coating method such as spray coating and dip coating.

In the image forming apparatus of the present invention, predetermined reference toner images are preferably formed on the transfer belt 3 in the same manner as described in JP-As 2002-49193 and 2002-148876 incorporated herein by reference to check the toner images with a toner image sensor 31. The charging conditions, light irradiating conditions, and developing conditions are adjusted depending on the results of the check of the toner images.

In this embodiment, the transfer belt 3 is made of a semi-transparent film such as polyvinylidene fluoride resins and polyethylene terephthalate resins. A light emitting element and a light receiving element, which serves as the toner image sensor 31, are provided at a position above the transfer belt 3. In addition, a reflection member 32 is provided below the transfer belt 3 so as to face the toner image sensor 31.

The way to check the reference toner images formed on the transfer belt 3 will now be explained.

Figure 2:
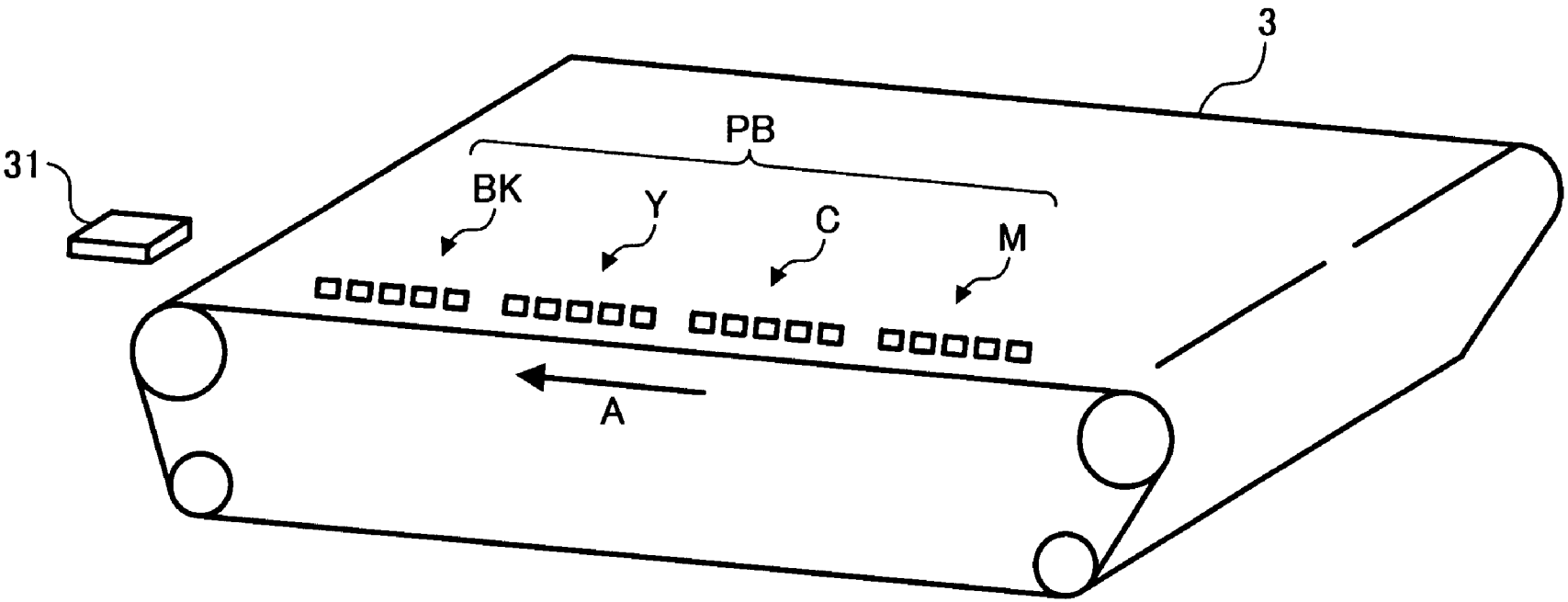
FIG. 2 is a schematic view illustrating a reference toner image formed on a transfer medium of the color printer illustrated in FIG. 1.

As illustrated in FIG. 2, reference color toner images (M, C, Y and BK images) having a predetermined pattern are formed on the transfer belt 3. The light emitted by the light emitting element causes regular reflection and irregular reflection at the reflection member 32. The light of either one of the regular reflection light or the irregular reflection light or both of them is detected with the light receiving element.

When the reference toner images reach a position at which the toner images face the toner image sensor 31 and reflection member 32, the quantity of the light reaching the reflection member 32 after passing through the toner images, and the quantity of the light returned from the reflection member 32 to the toner image sensor 31 decreases. In contrast, when there is no reference toner image, the light emitted from the light emitting element is reflected from the reflection member 32 after passing through the transfer belt 3, and the light is received by the light receiving element after passing through the transfer belt 3. Therefore, the quantity of the light received by the toner image sensor 31 is large, resulting in increase in the level of the signal output by the toner image sensor 31. Thus, a high S/N ratio can be obtained, namely, the toner image sensor 31 has a high ability so as to precisely determine the amount of the toner layer formed on the transfer belt 3.

The reflection member 32 has a flat surface so as to be easily subjected to a surface processing and to have high reflectivity. In addition, when the reflection member 32 is flat, the deviation of the light reflected from the reflection member 32 can be minimized even when the light emitted from the light emitting element is slightly deviated. In addition, the reflection member 32 supports the backside of the transfer belt 3, and thereby the transfer belt 3 can be stably rotated. Namely, the position of the reference toner images can be stabilized, and thereby the amount of the toner image layer can be precisely determined, resulting in increase in the S/N ratio. Further, by using a reflection type sensor is used as the toner image sensor 31, a light emitting element and a light receiving element can be supported by only one support. Therefore, the operation of positioning the toner image sensor 31 and the reflection member 32 is relatively easy compared to the operation of positioning conventional transmittance toner image sensors.

The reference toner images are removed with a cleaner (not shown) after the amount of the toner images is determined. The image forming conditions are adjusted depending on the results of this reference toner image checking.

As described in JP-A 2002-148876, the toner image sensor 31 can also be used as a toner image position sensor which determines whether color toner images are overlaid while misaligned.

In general, a material having a smooth surface and a good toner releasability is used for the transfer belt 3. Therefore, the transfer belt 3 has a poor toner image receiving ability. On the other hand, materials (such as ozone) generated by discharging occurring between the charger and the photoreceptor change the properties of the surface of the photoreceptor, resulting in increase in friction coefficient of the surface of the photoreceptor. Therefore, the toner image transferring from the photoreceptor to the transfer belt cannot be well performed. When reference toner images as illustrated in FIG. 2 are formed under such conditions, the resultant reference toner images often have omissions. If there are omissions in the reference toner images, the positions of the reference toner images cannot be precisely determined, resulting in occurrence of a misalignment problem in that color toner images are overlaid while misaligned.

In the image forming apparatus of the present invention, a lubricant is preferably applied to the surface of the photoreceptors therein so that the photoreceptors can maintain a proper friction coefficient and reference toner images on the photoreceptors can be well transferred to the transfer belt. Since the reference toner images can also be formed without omissions, the positions of the reference toner images can be precisely determined and thereby occurrence of misalignment of color toner images can be prevented.

The friction coefficient of the surface of the photoreceptors is preferably from 0.10 to 0.30 and more preferably from 0.15 to 0.25. When the friction coefficient is too large, the effect in improving the toner transferring is little. In contrast, in order to maintain the friction coefficient to be less than 0.10, a large amount of lubricant has to be applied to the surface of the photoreceptors, and thereby the lubricant has to be frequently replenished, which is troublesome. In addition, when the photoreceptors have a friction coefficient in this range, the cleanability of the photoreceptors can be improved.

In the image forming apparatus of the present invention, the surface of the transfer belt 3 preferably has a friction coefficient greater than that of the surface of the photoreceptors. In this case, reference toner images can be easily transferred from the photoreceptors to the transfer belt,and thereby the images can be precisely evaluated, resulting in improvement of the image qualities. In addition, the reference toner images can also be transferred without omissions, and thereby occurrence of misalignment of color toner images can also be prevented.

In general, papers used as the receiving material typically have concavity and convexity on the surface thereof, and have a higher friction coefficient than that of the photoreceptors. In contrast, the transfer belt 3 typically has a smooth surface and has a lower friction coefficient than that of the photoreceptors. In such a case, toner transferring from the photoreceptors 5 to the transfer belt 3 is different from that from the photoreceptors 5 to the receiving paper P. Specifically, the amount (i.e., weight) of the toner image (reference toner images) formed on the transfer belt 3 is different from that of the toner image formed on the paper P. Namely, the results of checking the reference toner images on the transfer belt cannot be well reflected to improvement of the image qualities of the images on the paper P, and for example, problems in that images having too high image density or too low image density are produced tend to occur.

In the image forming apparatus of the present invention, the surface of the transfer belt 3 has a friction coefficient, which is higher than that of the photoreceptors 5 and which is near the friction coefficient of receiving materials, and thereby toner images can be well transferred from the photoreceptors to receiving materials via the transfer belt, resulting in improvement of the image qualities.

In the present invention, the coefficient of static friction of the surface of the photoreceptor means the coefficient of static friction and is measured by an Euler belt method. The Euler belt method will be explained.

Figure 11:
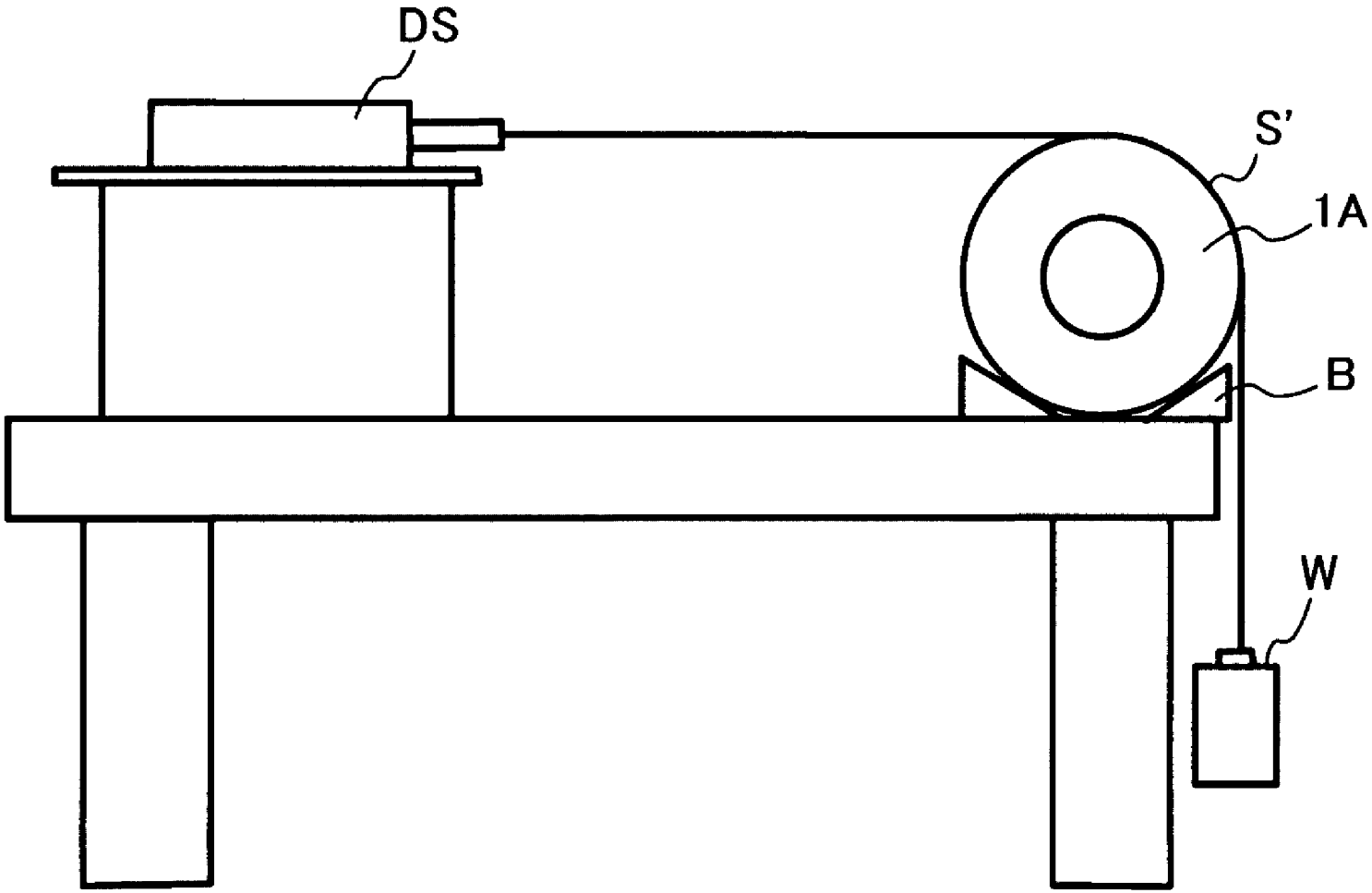
FIG. 11 is a schematic view illustrating an embodiment of the instrument of measuring the coefficient of static friction of surface of a photoreceptor using an Euler belt method.

The measuring instrument for use in the Euler belt method is illustrated in FIG. 11.

A character S' denotes a paper TYPE 6200 from Ricoh Co., Ltd., which has a size of 30 mm in width and 297 mm in length. Two hooks are set at each end of the paper S', and a load w (100 g) is set at one hook and a digital force gauge DS is set at the other hook. The paper S' is set in the measuring instrument so as to contact a photoreceptor 1A which is held by a block B, as illustrated in FIG. 11. The paper S' contacts one fourth of the peripheral surface of the photoreceptor 1A. The paper S' is pulled slowly with the digital force gauge DS. Provided that a force at which the paper S' starts to move is F, the coefficient of static friction of the photoreceptor 1A is determined by the following equation:

$$\mu s=(\pi/2)ln(F/w)$$

wherein μs is the coefficient of static friction of the photoreceptor 1A, F is the measured value of the force, and w is the load.

The friction coefficient of the transfer belt, which can maintain a cylindrical form, is measured after winding the belt on a cylinder.

Figure 3:
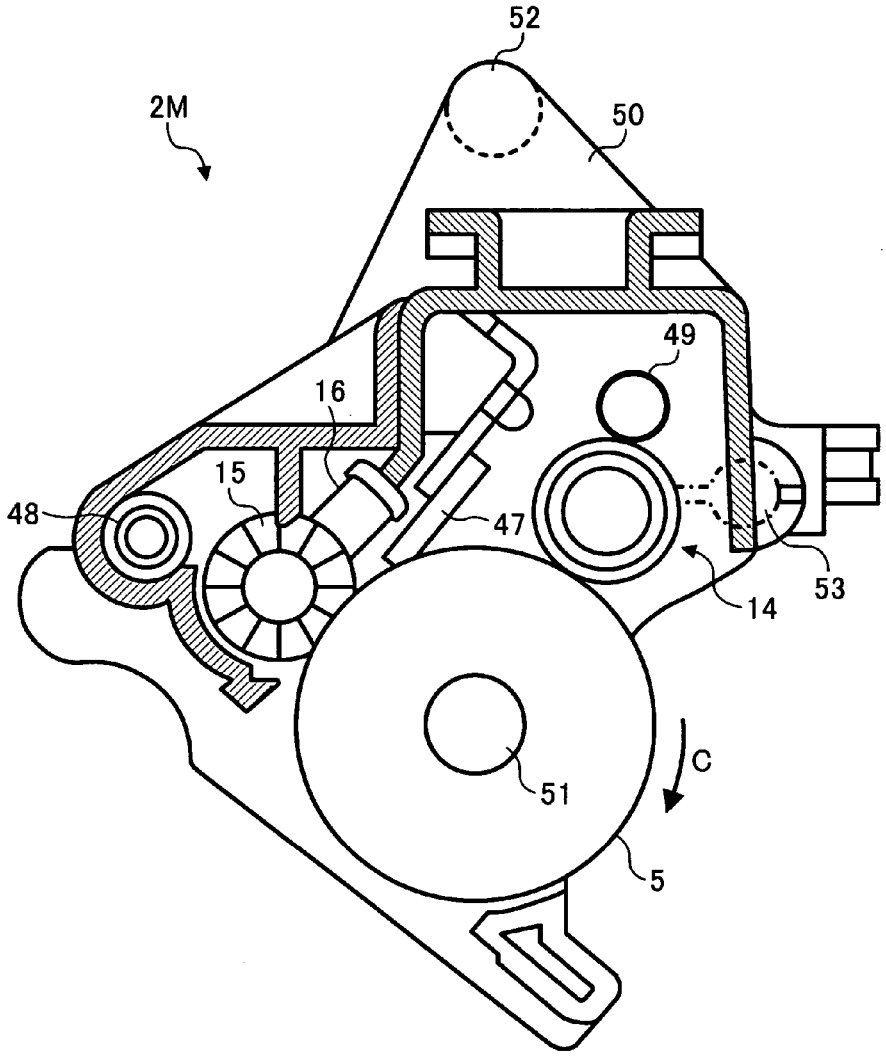
FIG. 3 is a schematic view illustrating an image forming unit of the color printer illustrated in FIG. 1.

FIG. 3 illustrates a photoreceptor unit for use in the image forming apparatus of the present invention. Since the photoreceptor units have the same structure, only the magenta photoreceptor unit 2M will be explained.

The photoreceptor unit 2M includes the photoreceptor 5; the charging roller 14 configured to uniformly charge the photoreceptor 5; and a brush roller 15 and a cleaning blade 47, which clean the surface of the photoreceptor 5.

Figure 5:
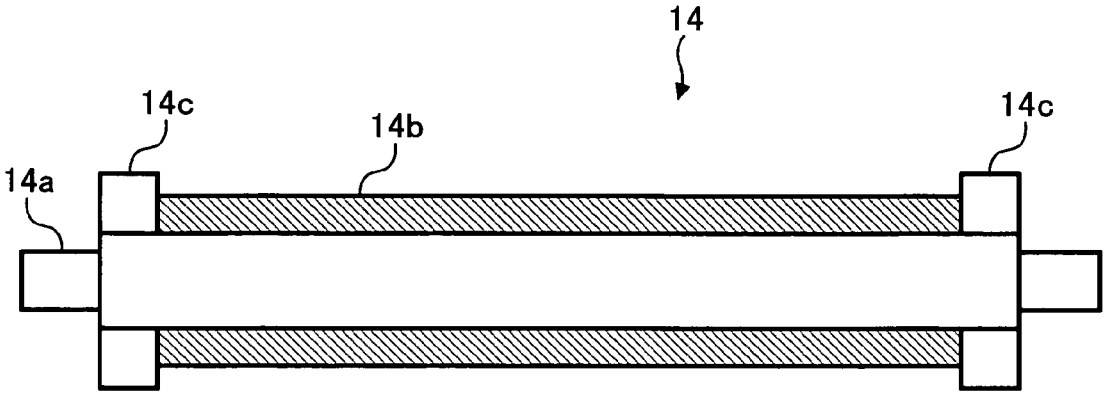
FIG. 5 is a schematic view illustrating the cross-section of a charging roller for use in the image forming apparatus of the present invention.

As illustrated in FIG. 5, on both ends of the charging roller 14, a gap forming member 14*c* is provided. Since the gap forming member 14*c* contacts non-image areas of the photoreceptor 5, a small gap is formed between the image forming area of the photoreceptor 5 and the surface of a charging portion 14*b* of the charging roller 14.

Thus, the charging portion 14*b* does not contact the surface of the photoreceptor 5. Therefore, if the charging portion 14*b* is made of a hard resin, the charging roller 14 does not scratch the surface of the photoreceptor 5. The gap is preferably not greater than 100 μm. Therefore, the photoreceptor 5 and the charging roller 14 have to be processed with high precision, namely, the straightness of the photoreceptor 5 and the charging roller 14 is preferably not greater than 20 μm.

In addition, on both ends of the charging roller 14, a gear (not shown) is provided to be engaged with gears provided on flanges arranged on both ends of the photoreceptor 5. Therefore, when the photoreceptor 5 is rotated by a driving motor (not shown), the charging roller 14 is also rotated while driven by the photoreceptor 5.

Referring back to FIG. 3, a cleaning roller 49 is provided at a position above the charging roller 14 to clean the surface of the charging roller 14. The cleaning roller 49 has a metal core and hairs made of an electroconductive fiber are attached to the metal core by an electrostatic method. The cleaning roller 49 contacts the charging roller 14 with its own weight and rotates while being driven by the charging roller 14. Thus, the surface of the charging roller 14 is cleaned by the cleaning roller 49.

Even when the photoreceptor 5 and the charging roller 14 have a straightness not greater than 20 μm, the gap therebetween varies within a certain range. In order to uniformly charge the photoreceptor even under such conditions, it is preferable that the charging portion 14*b* apply a DC bias overlapped with an AC bias which has a peak-to-peak voltage not less than twice the voltage at which discharging starts to occur between the charging portion 14*b* and the surface of the photoreceptor 5. The frequency of the AC bias is preferably from 7 to 12 times the linear velocity of the image bearing member. When the frequency is too low, stripe-form uneven charging is caused, resulting in formation of undesired stripe images. In contrast, when the frequency is too high, excessive charging is performed, thereby increasing the abrasion amount of the photoreceptor. In addition, a film of the toner used and the external additive in the toner tends to be formed on the surface of the photoreceptor. In the present embodiment, the linear velocity of the photoreceptor is 125 mm/s and the frequency of the AC bias is 900 Hz.

As illustrated in FIG. 3, the brush roller 15 configured to clean the surface of the photoreceptor contacts a solid lubricant 16. Since the brush roller 15 rotates, foreign materials adhered to the surface of the photoreceptor are removed and in addition the lubricant is applied to the surface of the photoreceptor 5. Specific examples of the solid lubricants include fatty acid metal salts such as zinc stearate, barium stearate, iron stearate, nickel stearate, cobalt stearate, copper stearate, strontium stearate, calcium stearate, magnesium stearate, zinc oleate, manganese oleate, iron oleate, cobalt oleate, magnesium oleate, zinc palmitate, manganese palmitate, iron palmitate, cobalt palmitate, and magnesium palmitate; natural waxes such as carnauba waxes; and fluorine-containing resins such as polytetrafluoroethylene.

Among these lubricants, fatty acid metal salts are preferably used.

The lubricant applied to the surface of the photoreceptor is scraped off by the developer located on the developing sleeve due to differences in rotational speed between the photoreceptor and the developing sleeve, and thereby a small amount of lubricant is included in the developer. When a fatty acid metal salt is used as the lubricant, the charge properties of the carrier and the toner in the developer are hardly deteriorated by the fatty acid metal salt because fatty acid metal salts generally have a small polarity.

The cleaning blade 47 is typically made of a polyurethane rubber. In general, a powder is applied to the cleaning blade 47 to decrease the friction between the cleaning blade and the photoreceptor, i.e., to prevent the cleaning blade from turning back toward the charging roller 14. In this case, if the powder is adhered to the charging roller, a problem in that the photoreceptor is unevenly charged occurs. In the image forming apparatus of the present invention, it is not necessary to apply such a powder thereto because the friction coefficient of the photoreceptor is decreased by applying a lubricant to the photoreceptor. Therefore, such a problem as mentioned above is not caused.

The lubricant applying operation will now be explained in detail.

When the photoreceptor unit is activated and the photoreceptor 5 is rotated, the brush roller 15 is rotated. Since a solid lubricant 16 is contacted with the brush roller 15, the solid lubricant 16 is scraped off by the brush roller 15. The solid lubricant on the brush roller is applied to the surface of the photoreceptor 5.

Since the solid lubricant 16 is gradually decreased by being scraped off, the pressure of the lubricant to the brush roller changes. In addition, toner particles remaining on the surface of the photoreceptor adhere to the brush roller, and thereby a problem in that the lubricant cannot be well applied to the surface of the photoreceptor occurs.

Specifically, in a case where toner particles are hardly adhered to the brush roller, the lubricant scraped off by the brush roller is applied to the photoreceptor and uniformly extended along the surface of the photoreceptor by the cleaning blade 47. Thus, the lubricant application operation is efficiently performed. In contrast, in a case where a large amount of toner particles are adhered to the brush roller, the lubricant is scraped in a large amount because the toner particles have good grinding ability. Therefore, a large amount of toner particles and a large amount of lubricant are applied to the surface of the photoreceptor. In this case, the lubricant cannot be well extended by the cleaning blade 47. Therefore the lubricant application operation is not efficient.

In the image forming apparatus, the lubricant application controller controls the lubricant application operation so as to be performed during a time in which the image forming operation is not performed. Therefore, the lubricant can be always applied to a surface of the photoreceptor which bears a small amount of residual toner particles thereon. Accordingly, high quality images can be stably produced for a long period of time.

The lubricant application operation can be performed at a non-image forming time after predetermined copies are produced. By using this method, the lubricant application operation can be well performed, and thereby high quality images can be produced more stably for a long period of time.

In the image forming apparatus, the lubricant application operation is performed while the developing device is not operated. Therefore, it is possible to prevent toner particles from adhering to the rotating photoreceptor when the lubricant application operation is performed. In addition, it becomes possible to accelerate releasing of the toner particles adhered to the brush roller 15 therefrom. Accordingly, the lubricant can be applied more efficiently with the brush roller from which toner particles adhered thereto are removed.

As mentioned above, when the lubricant is applied, the developing operation of the developing device 10 is preferably stopped. In this case, it is preferable to separate the developing roller from the photoreceptor. Alternatively, it is also preferable to stop the rotation of the developing roller if the developing roller cannot be separated from the photoreceptor.

In addition, when the lubricant application operation is performed, it is preferable not to rotate the charging roller 14. Similarly to the case of the developing roller, it is preferable to separate the charging roller from the photoreceptor if the charging roller is a contact charger. Alternatively, it is also preferable not to apply a charge bias when the charging roller is not separated from the photoreceptor.

Thus, by applying a lubricant to the surface of the photoreceptor 5, the friction coefficient of surface of the photoreceptor decreases. In order to decrease the amount of toner particles remaining on the photoreceptor, it is preferable that the friction coefficient of the surface of the photoreceptor is as low as possible. However, when materials such as ozone generated by discharging adhere to the photoreceptor, the friction coefficient thereof increases.

By stopping the operation of the charging roller during the lubricant application operation, production of the discharge-induced materials can be prevented. Therefore, a toner transporting auger 48 can continue the operation of removing the toner particles adhered to the brush roller 15 just before the lubricant application operation is started. Thus, the lubricant application operation can be efficiently performed using the brush roller from which considerable amount of toner particles is removed.

In the image forming apparatus of the present invention, the toner consumption per unit time is measured using a clock function of the controller. When the toner consumption is greater than the predetermined amount, the lubricant application operation is performed.

Toner particles fed to the cleaning device are toner particles remaining on the photoreceptor without being transferred to receiving materials. Therefore, the image area proportion of the images produced largely influence on the amount of the residual toner particles, i.e., the greater the image area proportion, the greater the amount of residual toner particles.

In the present invention, when the toner consumption is greater than a predetermined amount, the lubricant application operation is performed and thereby the lubricant can be applied to the photoreceptor while the toner particles adhered to the brush roller is removed therefrom.

JP-A 08-234642 discloses a technique in that the image area proportion is calculated. However, when 100 copies are reproduced, the rotation number of the photoreceptor is largely different between a case where the copies are produced one by one and a case where the copies are continuously produced.

In the present invention, the toner consumption is measured while the rotation number (or rotation time) of the photoreceptor is checked by a rotation detecting device. Then the amount of toner particles adhered to the brush roller is estimated from the measurement results, and it is determined whether the lubricant application operation is performed. The toner consumption can be determined by counting the number of the pixels written or measuring the amount of toner replenished. This measurement is performed by a toner consumption detecting device.

By using the above-mentioned method, adhesion of an excessive amount of toner particles to the brush roller can be prevented and the lubricant application operation can be well performed.

The data concerning the rotation number (or rotation time) and toner consumption can be stored in an area of the controller. The lubricant application operation can be performed while periodically referring to the data.

When the lubricant application operation is performed, a bias can be applied to the brush roller 15, which is made of an electroconductive material, by a bias application device. By using this method, the toner particles adhered to the brush roller can be effectively removed utilizing an electrostatic force as well as the mechanical scraping force.

It is preferable to apply a bias having a polarity opposite to that of charge of the toner to the brush roller 15 to effectively remove toner particles from the brush roller. It is preferable that a DC voltage overlapped with an AC voltage is applied as the bias.

However, when the lubricant application operation is performed while a bias having a polarity opposite to that of the toner is applied to the brush roller, toner particles are attracted by the brush roller, and thereby the toner particles tend to be fixedly adhered to the brush roller. Therefore, it becomes difficult to remove the toner particles from the brush rollers. Accordingly, it is preferable to apply a bias having an opposite polarity (i.e., a polarity same as that of the toner) to the brush during the lubricant application operation. Alternatively, it is also preferable not to apply a bias during the lubricant application operation. By using these methods, toner particles adhered to the brush roller can be effectively removed therefrom.

When color images are produced in color copiers and printers, the image areas are typically different among color images. Therefore, the amounts of color toner particles adhered to the respective brush rollers are largely different from the others. In this case, when the lubricant application operation is performed on each photoreceptor at the same time, the lubricant 16 is excessively applied to the photoreceptor producing color images with a relatively small image area. This is not preferable in view of running costs. In addition, the excessively applied lubricant tends to adhere to the charging roller 14, thereby causing uneven charging. Therefore, it is preferable to use a lubricant application determining device which is configured to determine whether the lubricant application operation is performed for each photoreceptor.

In the image forming apparatus, each photoreceptor can be independently rotated and the lubricant application operation is performed on only the photoreceptor on which the lubricant should be applied. Therefore, the above-mentioned problem can be avoided.

When the lubricant application operation is performed on the photoreceptors at different times, it is preferable that the photoreceptors 5 are separated from the transfer belt 3. This is because when either one of the photoreceptor or the transfer belt is rotated while they are contacted with each other, the photoreceptor and/or the transfer belt are scratched due to the friction between the photoreceptor and the transfer belt.

In the present embodiment, the photoreceptor 5BK for black color cannot be separated from the transfer belt 3. It is preferable that when the lubricant application operation is performed on the photoreceptor 5BK, the transfer belt 3 is also rotated synchronously.

Toner particles collected by the cleaning blade 47 and the brush roller 15 are transferred to the toner transporting auger 48. By rotating the toner transporting auger 48, the collected toner particles are transported to a toner collecting device 18 as illustrated in FIG. 1.

In this embodiment, the photoreceptor 5 has a diameter of 30 mm and rotates in a direction indicated by an arrow C illustrated in FIG. 3 at a speed of 125 mm/s. The brush roller 15 also rotates in the clockwise direction while being synchronized with the photoreceptor 5.

The photoreceptor unit 2M can be detachably set in the image forming apparatus. As illustrated in FIG. 3, the photoreceptor unit 2M has a main reference portion 51 for positioning. In addition, a sub-reference portion 52 is provided on a bracket 50 on the front side of the photoreceptor unit 2M, and another sub-reference portion 53 is provided on the bracket 50 on the rear side of the photoreceptor unit 2M. Therefore the photoreceptor unit 2M can be set to the proper position of the image forming apparatus.

When a stick of a fatty acid metal salt which has been prepared by melting a powder of the fatty acid metal salt, followed by cooling is used as the solid lubricant, the stick tends to cause cracking or chipping. Therefore it is necessary to carefully handle the stick. By using a process cartridge including at least the photoreceptor 5, the lubricant 16 and the brush roller 15 which are integrated, the lubricant can be replaced without causing problems such as cracking or chipping. The process cartridge preferably includes the charging roller 14. In this case, the photoreceptor and the charging roller can be precisely positioned (i.e., a uniform gap is formed between the photoreceptor and the charging roller). The process cartridge is not limited thereto, and the developing device can also be incorporated therein.

The photoreceptor 5 will now be explained in detail.

Figure 4A:
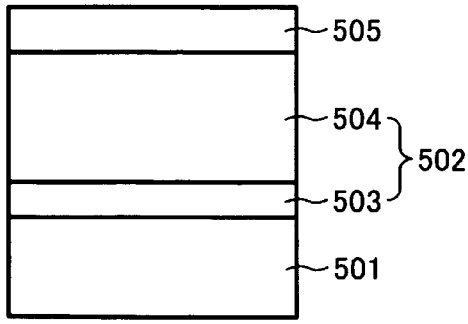
FIGS. 4A and 4B are schematic views illustrating the cross-sections of photoreceptors for use in the image forming apparatus of the present invention.
Figure 4B:
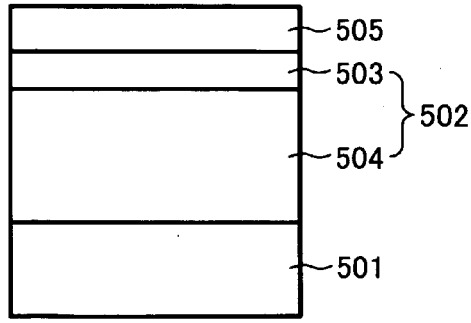

An example of the photoreceptor is illustrated in FIG. 4A. The photoreceptor includes an electroconductive substrate 501, a photosensitive layer 502 located on the electroconductive substrate 501, and a protective layer 505 located on the photosensitive layer 502. The photosensitive layer 502 includes a charge generation layer 503 and a charge transport layer 504 located on the charge generation layer 503. The charge generation layer 503 can be formed on the charge transport layer 504 as illustrated in FIG. 4B.

Suitable materials for use as the electroconductive substrate 501 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, iron and the like, or a metal oxide such as tin oxides, indium oxides and the like, is formed by a method such as vapor deposition and sputtering. In addition, a plate of a metal such as aluminum, aluminum alloys, nickel and stainless steel can be used. A metal cylinder can also be used as the substrate 501, which is prepared by tubing a metal such as aluminum, aluminum alloys, nickel and stainless steel by a method such as drawing ironing, impact ironing, extruded ironing, extruded drawing or cutting, and then subjecting the surface of the tube to cutting, super finishing, polishing and the like treatments.

The charge generation layer 503 includes a charge generation material as a main component. Suitable materials for use as the charge generation material include inorganic and organic materials. Specific examples thereof include monoazo pigments, disazo pigments, trisazo pigments, perylene pigments, perynone pigments, quinacridone pigments, quinone based condensed polycyclic compounds, squaric dyes, phthalocyanine pigments, naphthalocyanine pigments, azulenium pigments, selenium, selenium-tellurium alloys, selenium-arsenic alloys, amorphous silicon, etc. These charge generation materials can be used alone or in combination.

The charge generation layer can be typically formed by the following method:

(1) a coating liquid is prepared by mixing an inorganic or organic charge generation material with a solvent such as tetrahydrofuran, cyclohexanone, dioxane, dichloroethane, butanone or the like, optionally together with a binder resin, and then dispersing the materials with a ball mill, an attritor, a sand mill or the like;

(2) the coating liquid is coated on a substrate by a method such as dip coating, spray coating, and bead coating; and (3) the coated liquid is dried to form the charge generation layer.

Suitable materials for use as the binder resin include polyamide resins, polyurethane resins, polyester resins, epoxy resins, polyketone resins, polycarbonate resins, silicone resins, acrylic resins, polyvinylbutyral resins, polyvinylformal resins, polyvinyl ketone resins, polystyrene resins, etc. The added amount of the binder resin is preferably from 0 to 2 parts by weight per 1 part by weight of the charge generation material used.

The charge generation layer can also be prepared by a vacuum thin film preparation method.

The thickness of the CGL is preferably from about 0.01 to about 5 μm, and more preferably from about 0.1 to about 2 μm.

The charge transport layer 504 is typically prepared by the following method:

(1) a coating liquid is prepared by dissolving or dispersing a charge transport material and a binder resin, optionally together with additives such as plasticizers and leveling agents, in a proper solvent; and (2) the coating liquid is coated on the charge generation layer (or the substrate), followed by drying to prepare the charge transport layer.

Charge transport materials are classified into positive-hole transport materials and electron transport materials. In addition, charge transport materials can also be classified into low molecular weight charge transport materials and charge transport polymers.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, and the like.

These electron transport materials can be used alone or in combination.

Specific examples of the positive-hole transport materials include electron donating materials such as oxazole derivatives, oxadiazole derivatives, imidazole derivatives, triphenyl amine derivatives, 9-(p-diethylaminostyrylanthrathene), 1,1-bis-(4-dibenzylaminophenyl)propane, styryl anthrathene, styryl pyrazoline, phenyl hydrazone, α-phenyl stilbene derivatives, thiazole derivatives, triazole derivatives, phenazine derivatives, acridine derivatives, benzofuran derivatives, benzimidazole derivatives, thiophene derivatives, etc.

The positive-hole transport materials can be used alone or in combination.

When a charge transport polymer is used, the charge transport layer is typically prepared by the following method:

(1) the charge transport polymer is dissolved or dispersed in a proper solvent, optionally together with additives such as binder resins, low molecular weight charge transport materials, plasticizers, leveling agents, and lubricants, to prepare a coating liquid; and (2) the coating liquid is coated on the charge generation layer or the substrate.

The charge transport polymers are polymers including a group having a charge transport function in their main chains or side chains.

Specific examples of the resins for use as the binder resin of the charge transport layer include thermoplastic resins and thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, phenoxy resins, polycarbonate, cellulose acetate resins, ethyl cellulose resins, polyvinyl butyral, polyvinyl formal, polyvinyl toluene, acrylic resins, silicone resins, epoxy resins, melamine resins, urethane resins, phenolic resins and alkyd resins, but are not limited thereto.

Specific examples of the solvents used for forming the charge transport layer include tetrahydrofuran, dioxane, toluene, 2-butanone, monochlorobenzene, dichloroethane, methylene chloride, etc.

Suitable materials for use as the plasticizer in the charge transport layer include plasticizers for use in general resins such as dibutyl phthalate, and dioctyl phthalate. The added amount of the plasticizer is preferably 0 to 30% by weight based on the binder resin included in the charge transport layer.

Suitable materials for use as the leveling agent in the charge transport layer include dimethyl silicone oils such as silicone oils methyl phenyl silicone oils; and polymers and oligomers having a perfluoroalkyl group in their side chain. The added amount of the leveling agent is preferably 0 to 1% by weight based on the binder resin included in the charge transport layer.

The thickness of the charge transport layer is preferably from 5 to 30 μm.

The content of the charge transport in the photosensitive layer 502 is preferably not less than 40% by weight based on the weight of the charge transport layer 504. When the content is too low, the photosensitive layer 502 has a low photosensitivity. Therefore, the photoreceptor cannot be used for high speed image forming apparatus which performs image writing using a pulsed laser light beam.

The charge transport mobility of the photoreceptor 5 is preferably not less than $3\times10^{-5}$ $cm^2/V\cdot s$, and more preferably not less than $7\times10^{-5}$ $cm^2/V\cdot s$, at an electric field strength of from $2.5\times10^5$ to $5.5\times10^5$ V/cm. The structure of the photoreceptor is preferably adjusted so that the photoreceptor has such a charge transport mobility. The charge transport mobility can be determined by a Time Of Flight (TOF) method.

An undercoat layer can be formed between the electroconductive substrate 501 and the photosensitive layer 502 to improve adhesion between the substrate and the photosensitive layer; to prevent formation of moiré; to improve the coating property of the overlying layer; to reduce the residual potential; and to prevent injection of charges from the substrate into the photosensitive layer.

The undercoat layer typically includes a resin as a main component. Since the photosensitive layer is typically formed on the undercoat layer by coating a coating liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer can include a fine powder of metal oxides such as titanium oxide, silica, alumina, zirconium oxide, tin oxide and indium oxide, to prevent formation of moiré and to reduce the residual potential of the photoreceptor.

The undercoat layer can be formed by coating a coating liquid using a proper solvent and a proper coating method mentioned above for use in the photosensitive layer.

In addition, metal oxide layers formed by a sol-gel method using a silane coupling agent, titanium coupling agent or a chromium coupling agent can also be used as the undercoat layer.

Further, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0.1 to 5 μm.

The photoreceptor 5 preferably has a protective layer 505 which serves as an outermost layer and which preferably includes a particulate metal oxide to improve the durability of the photoreceptor and to protect the photosensitive layer 502.

Specific examples of the material for use in the protective layer 505 include styrene/acrylonitrile copolymers, styrene/butadiene copolymers, acrylonitrile/butadiene/styrene copolymers, olefin/vinyl monomer copolymers, chlorinated polyether resins, aryl resins, phenolic resins, polyacetal resins, polyamide resins, polyamideimide resins, acrylic resins, polyarylsulfone resins, polybutylene resins, polybutylene terephthalate resins, polycarbonate resins, polyether sulfone resins, polyethine resins, polyethylene terephthalate resins, polyimide resins, polymethyl pentene resins, polypropylene resins, polyphenylene oxide resins, polysulfone resins, polyurethane resins, polyvinyl chloride resins, polyvinylidene chloride resins, epoxy resins, etc.

The protective layer 505 preferably includes a particulate metal oxide to improve the abrasion resistance thereof. Specific examples of the metal oxide include alumina, silica, titanium oxide, tin oxide, zirconium oxide, indium oxide, etc.

The content of the metal oxide in the protective layer 505 is generally from 5 to 40% by weight, and preferably from 10 to 30% by weight, based on the total weight of the protective layer. When the content is too low, the abrasion resistance is hardly improved. In contrast, when the content is too high, the residual potential (i.e., the potential of a lighted portion of the photoreceptor) seriously increases, resulting in deterioration of the photosensitivity of the photoreceptor.

The protective layer 505 can include a dispersant which improves the dispersiveness of the particulate metal oxide dispersed therein. Suitable materials of the dispersant include dispersants for use in paints or the like. The added amount of the dispersant in the protective layer is generally from 0.5 to 4% by weight, and preferably from 1 to 2% by weight, based on the weight of the particulate metal oxide included therein.

The protective layer can include a charge transport material so that the charges generated in the charge generation layer can be securely transported to the surface of the protective layer, thereby neutralizing the charges formed on the surface of the protective layer, which results in formation of sharp electrostatic latent images on the photoreceptor. Specific examples of the charge transport material include the charge transport materials mentioned above for use in the charge transport layer.

The protective layer 505 is typically prepared by a spray coating method. The thickness of the protective layer is generally from 1 to 10 μm, and preferably from 3 to 8 μm. When the protective layer is too thin, the durability of the photoreceptor is hardly improved. In contrast, when the protective layer is too thick, the productivity of the photoreceptor deteriorates and the residual potential increases after long repeated use.

The particle diameter of the particulate metal oxide in the protective layer 505 is preferably from 0.1 to 0.8 μm. When the particle diameter is too large, the surface of the protective layer is roughened, thereby deteriorating the cleanability of the photoreceptor. In addition, imagewise light tends to scatter in the protective layer, and thereby the resolution of the resultant toner images deteriorates. In contrast, when the particle diameter is too small, the abrasion resistance of the resultant photoreceptor is hardly improved.

The outermost layer of the photoreceptor 5 can include a lubricant to protect the photosensitive layer 502 and to impart the proper friction coefficient mentioned above to the surface of the photoreceptor. It is possible to include a lubricant in the charge transport layer 504 when the layer serves as an outermost layer. However, since the thickness of the charge transport layer is not less than 10 μm, a large amount of lubricant has to be included in the charge transport layer. In this case, the charge properties of the photoreceptor tend to deteriorate, and therefore this is not preferable. Therefore, it is preferable to include a lubricant in the protective layer 505 serving as an outermost layer.

Suitable lubricants for use in the outermost layer include particulate fluorine-containing resins, particulate polyolefin resins, particulate silicone resins, etc. These materials can be used alone or in combination.

Specific examples of the fluorine-containing resins include homopolymers or copolymers of tetrafluoroethylene, hexafluoropropylene, trifluoroethylene, chlorotrifluoroethylene, vinylidene fluoride, vinyl fluoride and perfluoroalkyl vinyl ether. Suitable polyolefin resins include homopolymers and copolymers of ethylene, propylene, butene, etc, and derivatives thereof. Specific examples thereof include polyethylene, polypropylene, polybutene, polyhexene, ethylene/propylene copolymers, ethylene/butene copolymers, ethylene/propylene/hexene copolymers, etc.

Suitable silicone resins include silicone resins which have a three dimensional network of siloxane bonding and are insoluble in organic solvents and which are substituted with a group such as alkyl groups, aryl groups, amino-substituted alkyl groups, and dialkylsilicone groups. The three dimensional network of siloxane bonding can be prepared by a condensation reaction of silane compounds having three functional groups, such as tetraethoxy silane, trimethoxymethyl silane, trihydroxymethyl silane, dimethoxydimethyl silane, trimethoxy long-alkyl silane, and silicone oils having a silanol group at their end portions. These condensation products have different properties and various forms such as spherical forms and irregular forms, and therefore one or more proper materials can be chosen.

The present inventors have investigated the relationship between the particle diameter of the particulate lubricant in the outermost layer and the properties of the resultant photoreceptor such as surface roughness, friction coefficient and cleanability. A polycarbonate resin serving as a binder resin and a particulate PFA resin (perfluoroethylene/perfluoroalkoxyethylene copolymer) were dispersed in tetrahydrofuran while the average particle diameter of the particulate PFA resin was changed. The average particle diameter was measured with a centrifugal automatic particle diameter measuring instrument. The particulate PFA resin in the dispersion included primary particles and aggregated primary particles (i.e., secondary particles). The dispersions were coated on a photoreceptor by a spray coating method, followed by drying to prepare an outermost layer. The cleanability was evaluated by setting the photoreceptor in an electrophotographic copier. The results are as follows.

TABLE 1

| | No. 1 | No. 2 | No. 3 |
|---|---|---|---|
| Average particle diameter (μm) | 0.4 | 1.0 | 3.6 |
| Surface roughness Ra | 0.087 | 0.098 | 0.277 |
| Friction coefficient | 0.20 | 0.21 | 0.30 |
| Cleanability | Good | Good | Bad |

As can be understood from Table 1, the properties of the photoreceptors Nos. 1 and 2 are almost the same, but the surface roughness of the photoreceptor No. 3 is much larger than those of the photoreceptors Nos. 1 and 2. Due to large surface roughness, the effects of the lubricant cannot be well produced. In addition, due to large surface roughness, toner particles remaining on the surface of the photoreceptor cannot be well removed. Therefore, the average particle diameter of the particulate lubricant is preferably not greater than 3 μm.

Then the thickness of the outermost layer was studied. A particulate PFA resin was dispersed in a tetrahydrofuran solution of a polycarbonate resin such that the content of the PFA resin be 55% by weight and the PFA resin have a particle diameter of 1.0 μm. The dispersion was coated on a photoreceptor, which has an aluminum cylindrical substrate having a diameter of 30 mm, an undercoat layer with a thickness of 3.5 μm, a change generation layer with a thickness of 0.15 μm, and a charge transport layer with a thickness of 22 μm, by a spray coating method, followed by drying to prepare an outermost layer while the thickness of the outermost layer was changed so as to be 5, 9 and 13 μm on a dry basis.

The three photoreceptors Nos. 5, 6 and 7 and a photoreceptor No. 4 on which the dispersion was not coated were set in a color printer IPSIO COLOR 8100 to measure the potential (i.e., initial potential) of the charged photoreceptors and the potential of lighted portion (i.e., residual potential) of the photoreceptor. Image forming conditions were as follows:

Image forming speed: 125 mm/s

Charging voltage: AC (900 Hz in frequency)+DC (−700 V)

Image writing density: 600 dpi

Light source for image writing: laser diode with a wavelength of 655 nm

Power of LD on the surface of photoreceptor: 0.23 mW

The results are shown in Table 2.

TABLE 2

| | No. 4 | No. 5 | No. 6 | No. 7 |
|---|---|---|---|---|
| Thickness (μm) | 0 | 5 | 9 | 13 |
| Initial potential (V) | −660 | −660 | −655 | −650 |
| Residual potential (V) | −50 | −65 | −120 | −180 |

As can be understood from Table 2, the thicker the outermost layer, the lower the initial potential, and the greater the residual potential. When the residual potential is high, the initial potential has to be increased by increasing the voltage applied. In this case, the electric field increases, thereby deteriorating the photoreceptor, resulting in shortage of life of the photoreceptor. In particular, in the photoreceptor No. 7, the difference between the initial potential (−650 V) and the residual potential (−180 V) is less than 500 V. In this case, the initial potential has to be considerably increased, which is not preferable. In addition, when the outermost layer is too thin, the outermost layer is easily worn out. Therefore, the thickness of the outermost layer is preferably not less than 4 μm in order to impart long life to the photoreceptor.

The content of the lubricant in the outermost layer is not less than 30% by weight based on the total weight of the outermost layer. When the content is too low, the friction coefficient of the photoreceptor increases. In contrast, when the content is too high (not less than 80% by weight), the outermost layer becomes brittle.

In the outermost layer, the ratio of the area occupied by the lubricant to the other area is preferably not less than 10/90. When the outermost layer is constituted of, for example, a polycarbonate resin (specific gravity of 1.2) serving as a binder resin and a PFA resin (specific gravity of 2.1) serving as a lubricant, the PFA resin is preferably included in the outermost layer in an amount not less than 30% by weight and not less than 20% by volume.

As mentioned above, a metal oxide such as alumina, silica, titanium oxide, a tin oxide, zirconium oxide and indium oxide can be included in the outermost layer to improve the abrasion resistance of the outermost layer.

In order to prevent deterioration of photosensitivity and increase of residual potential, each of the layers of the photoreceptor can include additives such as antioxidants, plasticizers, ultraviolet absorbents, low molecular weight charge transport materials and leveling agents.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-Containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-Containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy)acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Specific examples of the leveling agents include dimethyl silicone oils, methylphenyl silicone oils, polymer and oligomers having a perfluoroalkyl group in their side chain, etc.

Then the charging roller for use in the image forming apparatus will be explained in detail.

FIG. 5 illustrates a charging roller for use in the image forming apparatus of the present invention. The charging roller 14 includes a core 14*a* serving as an electroconductive substrate, a resin layer 14*b* serving as a charging element, and a gap forming member 14*c*. The core 14*a* is typically made of a metal such as stainless steel and has a diameter of from 6 to 10 mm. When the diameter is too small, the charging roller is easily bent upon application of pressure thereto. In contrast, when the diameter is too large, the charging roller becomes large in size and has a heavy weight.

The resin layer 14*b* is preferably made of a material having a volume resistivity of from $10^4$ to $10^9$ Ω·cm. When the volume resistivity is too low, an electrical leakage tends to occur when the charging roller has a defective portion such as pinholes. In contrast, when the volume resistivity is too high, the charging operation cannot be well performed, and thereby a proper initial potential cannot be formed on the photoreceptor. The volume resistivity can be controlled by including an electroconductive material in the resin layer. Specific examples of the resin constituting the resin layer include polyethylene resins, polypropylene resins, polymethyl methacrylate resins, polystyrene resins, acrylonitrile/butadiene/styrene copolymers, polycarbonate resins, etc. These resin materials have good moldability and therefore can be easily molded.

Suitable electroconductive materials for use in the resin layer 14*b* include ionic conductive polymers having a quaternary ammonium group. Specific examples of such ionic conductive polymers include polyethylene, polypropylene, polybutene, polyisoprene, ethylene/ethylacrylate copolymers, ethylene/methylacrylate copolymers, ethylene/vinyl acetate copolymers, ethylene/propylene copolymers, and ethylene/hexene copolymers, which include a quaternary ammonium group. Some of these polymer materials are commercially available. The base polymer is not limited to polyolefins and other polymers can be used.

Conventional charging rollers typically include a resistivity controlling agent such as carbon black. However, when these charging rollers are used for short-range chargers, the charging rollers tend to cause abnormal discharging. Therefore, it is not preferably to use such resistivity controlling agents for the charging roller in the present invention.

Suitable materials for use in the gap forming member 14*c* include polyolefin resins mentioned above for use in the resin layer 14*b*, such as polyethylene resins, polypropylene resins, polymethyl methacrylate resins, polystyrene resins, acrylonitrile/butadiene/styrene copolymers, polycarbonate resins, etc. Since the gap forming member 14*c* is brought into contact with the surface of the photoreceptor, grades of the materials softer than those of the materials for use in the resin layer 14*b* are preferably used. In particular, polyacetal resins, ethylene/ethyl acrylate copolymers, polyvinylidene fluoride, tetrafluoroethylene/perfluoroalkylvinyl ether copolymers, and tetrafluoroethylene/hexafluoropropylene copolymers are preferably used because of having good slidability and hardly damaging the surface of the photoreceptor.

The charging roller is typically prepared by the following method:

(1) Such an ionic conductive material as mentioned above is uniformly mixed with a base resin using a kneader such as double axis kneaders. The mixing ratio of the ionic conductive material to the base resin is from 30/100 to 80/100 by weight.

(2) The resin layer 14*c* is formed on a metal cylinder 14*a* by molding the mixture prepared above, resulting in formation of the charging roller. The thickness of the resin layer 14*b* is preferably from 0.5 to 3 mm. When the resin layer 14*b* is too thick, the charging roller becomes large in size and the resistance of the charging roller increases, resulting in deterioration of charging efficiency.

(3) Then a gap forming member 14*c* is provided on both ends of the resin layer by a method such as press fitting, adhesion using an adhesive and combination thereof. After the gap forming member 14*c* is attached to the roller, the outer surface of the resin layer 14*b* is subjected to grinding or cutting so that a uniform gap is formed between the surface of the resin layer 14*b* and the surface of the photoreceptor. The way to form the gap forming member 14*c* is not limited to the method, and a method in which a charging portion and a gap forming member of the charging roller are formed at the same time by a molding method can also be used.

In the present invention, the charging portion 14*b* is made of a resin, and therefore the cutting operation can be performed thereon more easily and precisely than in a case where a rubber is used for the charging portion 14*b*. In addition, the variation of the diameter and hardness of the charging roller due to changes of environmental conditions is smaller in a case where the charging portion is made of a resin. Therefore, the variation of the gap can be minimized.

In addition, it is preferable to coat the surface of the resin layer 14*b* and the gap forming member 14*c* with a material to which toner particles hardly adhere and which has a thickness of several tens micrometer.

Then the toner for use in the image forming apparatus of the present invention will be explained.

In order to reproduce images having a dot density not less than 600 dpi, the toner preferably has a volume average particle diameter of from 3 to 7 μm. In addition, the ratio (Dv/Dn) of the volume average particle diameter (Dv) to the number average particle diameter (Dn) is from 1.00 to 1.40. As the ratio (Dv/Dn) approaches 1.0, the toner has a sharper particle diameter distribution. When the toner has a small particle diameter and a sharper particle diameter distribution, the toner has a uniform charge and thereby high quality images with little background fouling can be produced. In addition, when an electrostatic image transfer method is used, the image transfer rate can be improved.

Figure 6:
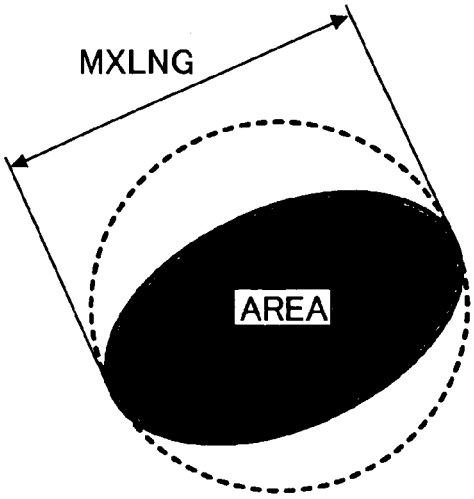
FIGS. 6 and 7 are schematic views used for explaining how the form factors SF-1 and SF-2 of a toner particle are determined.
Figure 7:
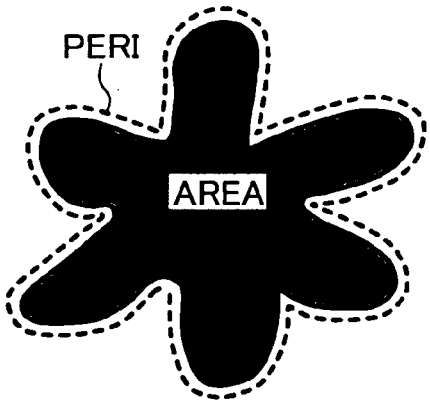

The particles of the toner for use in the image forming apparatus preferably have a form such that the form factors SF-1 and SF-2 of the toner fall in the specific ranges mentioned below. FIGS. 6 and 7 are schematic views for explaining the form factors SF-1 and SF-2, respectively.

As illustrated in FIG. 6, the form factor SF-1 represents the degree of the roundness of a toner and is defined by the following equation (1):

$$SF\text{-}1=\{(MXLNG)^2/(AREA)\}\times(100\,\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. It can be said that as the SF-1 increases, the toner form differs much from the true spherical form.

As illustrated in FIG. 7, the form factor SF-2 represents the degree of the concavity and convexity of a toner particle, and is defined by the following equation (2):

$$SF\text{-}2=\{(PERI)^2/(AREA)\}\times(100/4\pi) \quad (2)$$

wherein PERI represents the peripheral length of the image of a toner particle observed by a microscope; and AREA represents the area of the image.

When the SF-2 is 100, the surface of the toner particle does not have concavity and convexity. It can be said that as the SF-2 increases, the toner surface is much roughened.

The form factors SF-1 and SF-2 are determined by the following method:

(1) a photograph of particles of a toner is taken using a scanning electron microscope (S-800, manufactured by Hitachi Ltd.); and (2) particle images of 100 toner particles are analyzed using an image analyzer (LUZEX 3 manufactured by Nireco Corp.).

When the toner has a particle form near the true spherical form (i.e., the form factors SF-1 and SF-2 approach 100), the transfer efficiency increases. This is because the contact area of a particle of the toner with another particle of the toner decreases, resulting in decrease of the adhesion between the toner particles, and thereby the toner has good fluidity. In addition, the contact area of a particle of the toner with the photoreceptor also decreases, resulting in decreases of the adhesion of the toner particle to the photoreceptor, and thereby the transferability of the toner improves because the toner particles are easily influenced by a transfer bias. When the form factors SF-1 and SF-2 are too large, toner image transfer efficiency deteriorates.

Such a toner as mentioned above can be prepared by a pulverization method, but the method is inefficient, resulting in increase in manufacturing costs. Therefore it is preferable to prepare the toner by a method in which a dispersion prepared by dispersing toner constituents such as polyester prepolymers having a functional group having at least a nitrogen atom, polyester resins, colorants, and release agents in an organic solvent; adding the dispersion to an aqueous medium to subject the toner constituents to a crosslinking and/or an extending reaction. Then the toner constituents and the manufacturing method will be explained in detail.

The toner for use in the image forming apparatus of the present invention includes toner particles including a binder resin, a colorant, a charge controlling agent, a release agent, etc., and an external additive.

The toner includes a polyester resin as the binder resin. Particularly, the toner preferably includes an unmodified polyester resin, and a urea-modified polyester resin.

Unmodified polyester resins are prepared by a polycondensation reaction of a polyol with a polybasic carboxylic acid.

Suitable polyols include diols and polyols having three or more hydroxyl groups. Preferably, diols or mixtures in which a small amount of a polyol is added to a diol are used.

Specific examples of the diols include:

(1) Alkylene Glycols ethylene glycol, 1,2-propylene glycol, 1,3-propylene glycol, 1,4-butanediol, 1,6-hexanediol, etc.

(2) Alkylene Ether Glycols diethylene glycol, triethylene glycol, dipropylene glycol, polyethylene glycol, polypropylene glycol, polytetramethylene ether glycol, etc.

(3) Alicyclic Diols 1,4-cyclohexane dimethanol, hydrogenated bisphenol A, etc.

(4) Bisphenols bisphenol A, bisphenol F, bisphenol S, etc.

(5) Adducts of the alicyclic diols mentioned above with an alkylene oxide (i.e., ethylene oxide, propylene oxide and butylene oxide).

(6) Adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols include:

(1) Aliphatic Alcohols Having Three or More Hydroxyl Groups glycerin, trimethylol ethane, trimethylol propane, pentaerythritol, sorbitol, etc.

(2) Polyphenols Having Three or More Hydroxyl Groups trisphenol PA, phenol novolak, cresol novolak, etc.

(3) Adducts of the Polyphenols Mentioned Above with an Alkylene Oxide.

Suitable polycarboxylic acids include dicarboxylic acids and polycarboxylic acids having three or more carboxyl groups. Preferably, dicarboxylic acids or mixtures in which a small amount of a polycarboxylic acid is added to a dicarboxylic acid are used.

Specific examples of the dicarboxylic acids include:

(1) Alkylene Dicarboxylic Acids succinic acid, adipic acid, sebacic acid, etc.

(2) Alkenylene Dicarboxylic Acids maleic acid, fumaric acid, etc.

(3) Aromatic Dicarboxylic Acids phthalic acid, isophthalic acid, terephthalic acid, naphthalene dicarboxylic acids, etc.

Among these compounds, alkenylene dicarboxylic acids having from 4 to 20 carbon atoms and aromatic dicarboxylic acids having from 8 to 20 carbon atoms are preferably used.

Specific examples of the polycarboxylic acids having three or more hydroxyl groups include aromatic polycarboxylic acids having from 9 to 20 carbon atoms (e.g., trimellitic acid and pyromellitic acid).

As the polycarboxylic acid, anhydrides or lower alkyl esters (e.g., methyl esters, ethyl esters or isopropyl esters) of the polycarboxylic acids mentioned above can also be used for the reaction with a polyol (1).

Suitable mixing ratio (i.e., an equivalence ratio [OH]/[COOH]) of (the [OH] of) a polyol (1) to (the [COOH] of) a polycarboxylic acid (2) is from 2/1 to 1/1, preferably from 1.5/1 to 1/1 and more preferably from 1.3/1 to 1.02/1.

The polycondensation reaction is performed by heating monomers to a temperature of from 150 to 280° C. in the presence of an esterification catalyst (such as tetrabuthoxyde titanate and dibutyltin oxide), optionally under a reduced pressure condition to remove water generated in the reaction. Thus, a polyester resin having a hydroxyl group is prepared. The polyester resin included in the toner preferably has a hydroxyl value not less than 5 mgKOH/g, and an acid value of from 1 to 30 mgKOH/g and preferably from 5 to 20 mgKOH/g. A toner including a polyester resin having such an acid value tends to have a negative charging property. In addition, the toner has a good affinity for receiving papers, and thereby the toner has good low temperature fixability. However, when the acid value is too high, the charging property of the toner deteriorates particularly when the environmental conditions are changed.

The weight average molecular weight of the polyester resin included in the toner is preferably from 10,000 to 400,000 and more preferably from 20,000 to 200,000. When the weight average molecular weight is too low, the offset resistance of the toner deteriorates. When the weight average is too high, the low temperature fixability of the toner deteriorates.

The toner preferably includes a urea-modified polyester resin as well as an unmodified polyester resin. Urea-modified polyester resins can be prepared as follows:

(1) reacting the carboxyl groups and hydroxyl groups at the ends of such unmodified polyester resins as prepared above with a polyisocyanate compound to prepare a polyester prepolymer having an isocyanate group; and (2) reacting the polyester prepolymer with an amine to crosslink and/or extending the prepolymer.

Specific examples of the polyisocyanate compounds include:

(1) Aliphatic Polyisocyanates tetramethylene diisocyanate, hexamethylene diisocyanate, 2,6-diisocyanate methylcaproate, etc.

(2) Alicyclic Polyisocyanates isophorone diisocyanate, cyclohexylmethane diisocyanate, etc.

(3) Aromatic Didicosycantes tolylene diisocyanate, diphenylmethane diisocyanate, etc.

(4) Aromatic Aliphatic Diisocyanates $\alpha,\alpha,\alpha',\alpha'$-tetramethyl xylylene diisocyanate, etc.

(5) Isocyanurates; blocked polyisocyanates in which the polyisocyanates mentioned above are blocked with phenol derivatives, oximes or caprolactams; etc.

These compounds can be used alone or in combination.

Specific examples of the amines (B), which are reacted with a polyester prepolymer having an isocyanate group, include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the amines include:

(1) Aromatic Diamines phenylene diamine, diethyltoluene diamine, 4,4'-diaminodiphenyl methane, etc.

(2) Alicyclic Diamines 4,4'-diamino-3,3'-dimethyldicyclohexyl methane, diaminocyclohexane, isophoron diamine, etc.

(3) Aliphatic Diamines ethylene diamine, tetramethylene diamine, hexamethylene diamine, etc.

Specific examples of the polyamines having three or more amino groups include diethylene triamine, and triethylene tetramine. Specific examples of the amino alcohols include ethanol amine and hydroxyethyl aniline. Specific examples of the amino mercaptan include aminoethyl mercaptan and aminopropyl mercaptan. Specific examples of the amino acids include amino propionic acid and amino caproic acid. Specific examples of the blocked amines include ketimine compounds which are prepared by reacting one of the amines mentioned above with a ketone such as acetone, methyl ethyl ketone and methyl isobutyl ketone; oxazoline compounds, etc. Among these compounds, diamines and mixtures in which a diamine is mixed with a small amount of a polyamine having three or more amino groups are preferably used.

The urea-modified polyester resins can be prepared by the method as mentioned above using a one shot method or the like method. Specifically, an unmodified polyester resin is similarly prepared by the method as mentioned above. The unmodified polyester resin is reacted with a polyisocyanate compound to prepare a prepolymer having an isocyanate group.

At this point, the mixing ratio (i.e., [NCO]/[OH]) of (the [NCO] of) a polyisocyanate (3) to (the [OH] of) a polyester is generally from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate in the polyester prepolymer having a polyisocyanate group at its end portion is from 0.5 to 40% by weight, preferably from 1 to 30% by weight, and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

The polyester prepolymer having an isocyanate group is reacted with an amine at a temperature of from 0 to 140° C. so that the molecular chain is crosslinked or extended, resulting in formation of a urea-modified polyester resin.

The mixing ratio (i.e., an equivalence ratio [NCO]/[NHx]) of (the [NCO] of) the prepolymer having an isocyanate group to (the [NHx] of) the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

When a polyisocyanate compound is reacted with an unmodified polyester and a polyester prepolymer is reacted with an amine, a solvent can be used if desired. Specific examples of the solvent include solvents, which are not reacted with an isocyanate group, such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetoamide); and ethers (e.g., tetrahydrofuran).

The urea-modified polyesters may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The weight average molecular weight of the urea-modified polyester resins for use in the toner is generally not less than 10,000, preferably from 20,000 to 10,000,000, and more preferably from 30,000 to 1,000,000. When the molecular weight is too low, the hot offset resistance of the resultant toner deteriorates.

The number average molecular weight of the urea-modified polyesters is not particularly limited (i.e., the weight average molecular weight should be primarily controlled so as to be in the range mentioned above) when an unmodified polyester resin is used in combination therewith. Namely, controlling of the weight average molecular weight of the modified polyester resins has priority over controlling of the number average molecular weight thereof. However, when a urea-modified polyester is used alone, the number average molecular weight is from 2,000 to 15,000, preferably from 2,000 to 10,000 and more preferably from 2,000 to 8,000. When the number average molecular weight is too high, the low temperature fixability of the resultant toner deteriorates, and in addition the gloss of full color images decreases when the toner is used for color toners. By using a combination of an unmodified polyester and a urea-modified polyester, the low temperature fixability of the resultant toner and gloss of the resultant color toner images can be improved. Therefore it is preferable to use such a combination as the binder resin of the toner.

When a combination of a urea-modified polyester with an unmodified polyester is used as the binder resin, it is preferable that the urea-modified polyester at least can be partially mixed with the unmodified polyester to improve the low temperature fixability and hot offset resistance of the resultant toner. Namely, it is preferable that the modified polyester has a structure similar to that of the unmodified polyester. The mixing ratio (i/ii) of a modified polyester (i) to an unmodified polyester (ii) is generally from 5/95 to 80/20, preferably from 5/95 to 30/70, more preferably from 5/95 to 25/75, and even more preferably from 7/93 to 20/80. When the added amount of the urea-modified polyester is too small, the hot offset resistance of the resultant toner deteriorates and in addition it is hard to impart a good combination of high temperature preservability and low temperature fixability to the resultant toner.

The binder resin (i.e., the modified polyester and the unmodified polyester) preferably has a glass transition temperature (Tg) of from 45 to 65° C., and preferably from 45 to 60° C. When the glass transition temperature is too low, the high temperature preservability of the toner deteriorates. In contrast, when the glass transition temperature is too high, the low temperature fixability of the toner deteriorates. Since the urea-modified polyester resin is used as the binder resin, the resultant toner has better high temperature preservability than conventional toners including a polyester resin as a binder resin even if the modified polyester resin has a relatively low glass transition temperature.

Specific examples of the dyes and pigments for use as the colorant of the toner include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R(C.I. 12310), Permanent Red F4R (C.I. 12335), Permanent Red FRL (C.I. 12440), Permanent Red FRLL (C.I. 12460), Permanent Red F4RH(C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS(C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the image forming apparatus of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; copolymers of styrene and other vinyl compounds; and other resins such as polymethyl methacrylate, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The toner for use in the present invention can include a charge controlling agent to control the charge properties of the toner. Any known charge controlling agents can be used for the toner.

Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Among these materials, materials which can impart a negative charge property to the resultant toner can be preferably used. The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

The toner for use in the image forming apparatus of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes.

Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a masterbatch and a binder resin. Alternatively, the charge controlling agent and the release agent can be added to an organic solvent when the toner constituent liquid is prepared.

Then the external additive which is externally mixed with toner particles will be explained. A particulate inorganic material is typically mixed with toner particles to assist in improving the fluidity, developing property and charging ability of the toner particles. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a combination of a hydrophobic silica with a hydrophobic titanium oxide each having an average particle diameter not greater than 50 nm is used as an external additive, the electrostatic force and van der Waals' force between the external additive and the toner particles can be improved, and thereby the resultant toner has a proper charge quantity. In addition, even when the toner is agitated in a developing device, the external additive is hardly released from the toner particles, and thereby image defects such as white spots and image omissions are hardly produced. Further, the quantity of particles of the toner remaining on image bearing members can be reduced.

Titanium oxide exhibits high stability to withstand environmental conditions, and stably produce high density images. However, titanium oxide has a drawback in that the charge rising property of the toner deteriorates. Therefore it is not preferable that the content of titanium oxide is higher than that of silica. When the content of a hydrophobized titanium oxide is from 0.3 to 1.5% by weight, the charge rising property of the resultant toner hardly deteriorates. Therefore, images having good image qualities can be stably produced even when images are repeatedly produced.

In addition, a lubricant can be included in the toner as an external additive. In the method in which a solid lubricant scratched off by the brush roller is applied to the surface of the photoreceptor, a problem in that the friction coefficient of the photoreceptor increases when images with a high image area proportion are continuously produced tends to occur. This is because a large amount of toner particles are adhered to the cleaning device, and thereby the lubricant application operation performed by the brush roller is obstructed by the large amount of toner particles. In this case, when the toner includes a lubricant therein, the toner can apply a large amount of lubricant to the surface of the photoreceptor. Thus, lubricants can be applied to the photoreceptor by both the toner and the brush roller, and the friction coefficient of the photoreceptor can be controlled so as to fall in the preferable range mentioned above even when images with a high image area proportion are continuously produced.

Specific examples of the solid lubricants to be included in the toner include fatty acid metal salts such as zinc stearate, barium stearate, iron stearate, nickel stearate, cobalt stearate, copper stearate, strontium stearate, calcium stearate, magnesium stearate, zinc oleate, manganese oleate, iron oleate, cobalt oleate, magnesium oleate, zinc palmitate, manganese palmitate, iron palmitate, cobalt palmitate, and magnesium palmitate; and fluorine-containing resins such as polytetrafluoroethylene.

In particular, the molecular of fatty acid metal salts has a weak polarity and therefore fatty acid metal salts hardly affect the charge property of the toner and carrier. The particle diameter of the lubricant included in the toner is preferably from 0.5 to 5 μm, and the added amount of the lubricant is preferably from 0.01 to 0.5% by weight based on the total weight of the toner.

Then the method for preparing the toner for use in the present invention will be explained.

At first, a toner constituent liquid is prepared by dissolving or dispersing toner constituents such as a colorant, an unmodified polyester resin, a prepolymer having an isocyanate group and a release agent in an organic solvent. The organic solvent is preferably volatile solvents having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 75/100.

The toner constituent liquid is then dispersed in an aqueous medium in the presence of a surfactant and a particulate resin to prepare an emulsion. Suitable materials for use as the aqueous medium include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner constituent liquid is generally from 50/100 to 2,000/100 and preferably from 100/100 to 1,000/100. When the added amount of the aqueous medium is too low, the toner constituent liquid cannot be well dispersed, and thereby toner particles having a desired particle diameter cannot be prepared. Adding a large amount of aqueous medium is not economical.

When the toner constituent liquid is emulsified, a dispersant such as surfactants and particulate resins is preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, saltsofperfluoroalkyl(C6-C10)-N-ethylsulfonyl glycin, monoperfluoroalkyl(C6-C16) ethylphosphates, etc.

Specific examples of the cationic surfactants having a fluoroalkyl group include salts of primary, secondary and tertiary aliphatic amines having a fluoroalkyl group, aliphatic quaternary ammonium salts such as perfluoroalkyl (C6-C10)sulfoneamidepropyltrimethylammonium salts, benzalkonium salts, benzetonium chloride, pyridinium salts, imidazolinium salts, etc.

Particulate resins are added to the aqueous medium to stabilize the toner particles which are prepared in the aqueous medium. In this case, one or more particulate resins are added in an amount such that the particulate resins are present on the surface of the toner particles at a covering rate of from 10 to 90%. Specific examples of the particulate resins include particulate methyl methacrylate having a particle diameter of 1 μm, particulate polystyrene having a particle diameter of 0.5 or 2 μm, particulate poly(styrene-acrylonitrile) having a particle diameter of 1 μm, etc.

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner constituent liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

When the toner constituent liquid is added in an aqueous medium to prepare an emulsion, an amine is added to the mixture to react the amine with the polyester prepolymer having an isocyanate group. The reaction is accompanied with crosslinking and/or extension of the molecular chains of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and tioctyltin layrate can be used, if desired, for the reaction.

After the reaction, the organic solvent is removed from the emulsion (i.e., the reaction product), followed by washing and drying. Thus, toner particles are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme.

Then a charge controlling agent is fixed on the thus prepared toner particles and an external additive such as particulate inorganic materials (e.g., silica and titanium oxide) is added thereto. If desired, a particulate lubricant can also be added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

The thus prepared toner is contained in a container and the container is set in the image forming apparatus of the present invention. In addition, the toner is mixed with a carrier to prepare a developer. The developer is set in the developing device of the image forming apparatus of the present invention.

Suitable materials for use as the carrier in the two component developer include known magnetic carrier materials such as ferrite powders and magnetite powders, which have a particle diameter of from 20 to about 70 μm and which can be coated with a material. As the particle diameter of the carrier used is smaller, the resultant images have higher resolution. However, when the particle diameter is too small, the carrier tend to adhere to the electrostatic latent images, resulting in deterioration of the image qualities.

Specific examples of the material for use in covering the carrier materials include polymers of vinylidene fluoride, tetrafluoroethylene, hexafluoropropylene, perfluoroalkyl vinyl ether, vinyl ethers substituted with a fluorine atom and vinyl ketones substituted with a fluorine atom. The covering layer can be formed by coating these materials on carrier materials by a method such as spray coating methods and dip coating methods.

Then another embodiment of the image forming apparatus of the present invention will be explained.

Figure 8:
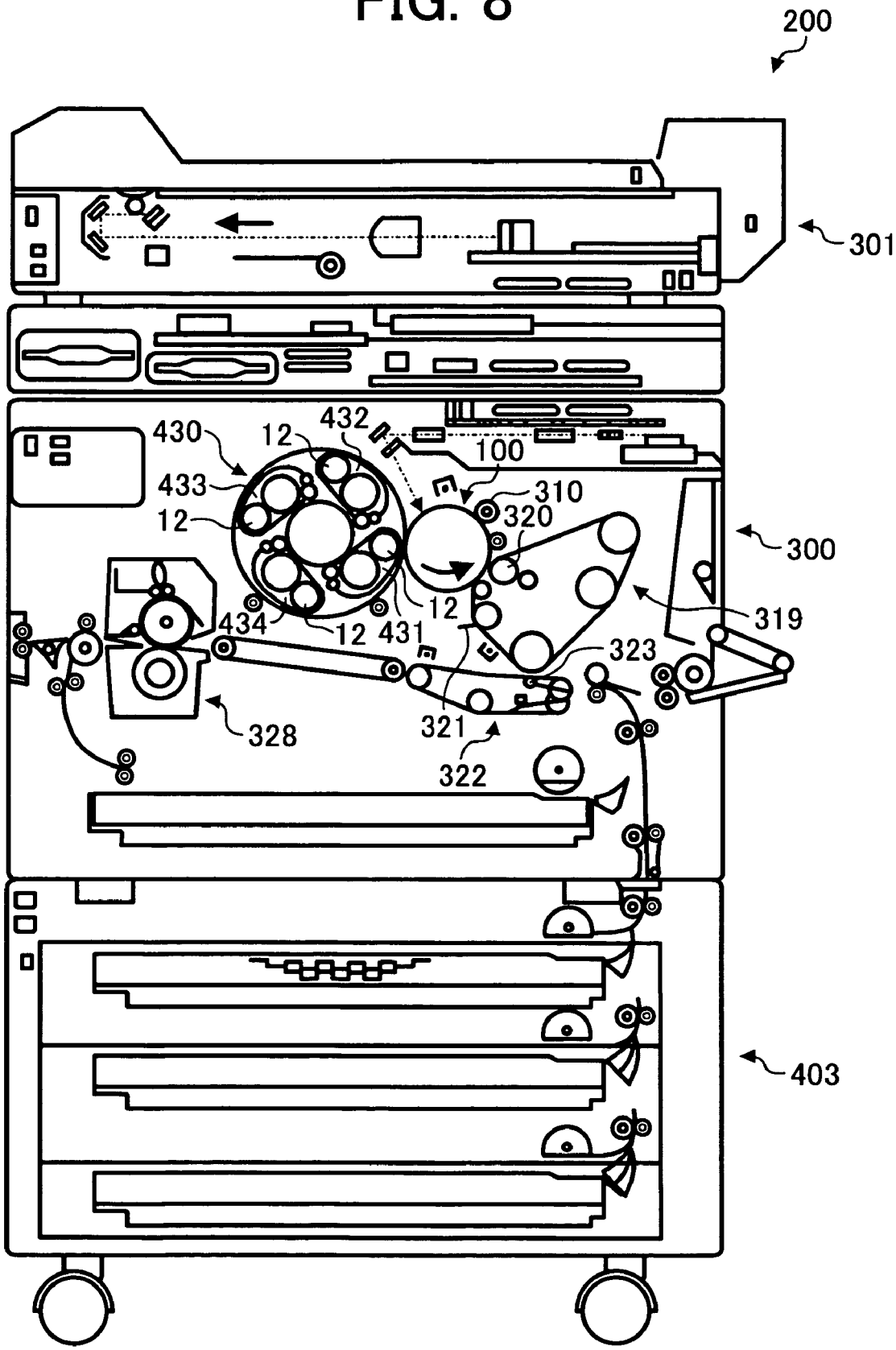
FIG. 8 is a schematic view illustrating a full color printer/copier having a revolver type developing device, which is an embodiment of the image forming apparatus of the present invention.

FIG. 8 is a schematic view illustrating an image forming apparatus 200 having a revolver developing unit 430. The revolver developing unit 430 includes a black developing device 431 performing a developing operation using a black (BK) developer including a black toner; a yellow developing device 432 performing a developing operation using a yellow (Y) developer including a yellow toner; a cyan developing device 433 performing a developing operation using a cyan (C) developer including a cyan toner; and a magenta developing device 434 performing a developing operation using a magenta (M) developer including a magenta toner. The entire of this revolver developing unit 430 is rotated in a counterclockwise direction by a driving device (not shown). Each of the developing devices has a paddle configured to scoop up and agitate the developer, a developing sleeve 12 configured to bear the developer to develop electrostatic latent images on a photoreceptor drum 100; a driving device configured to drive the developing sleeve 12, etc.

The revolver developing unit 430 in a waiting state achieves a home position at which the black developing device is located at a developing position (i.e., the developing sleeve thereof faces a photoreceptor drum 100). When a copy starting key is pushed, image data of an original are read by an image reader 301. Then light image is written by a laser light beam L according to the image data. Thus, an electrostatic latent image corresponding to the black color image of the original image is formed on the photoreceptor drum 100. Hereinafter this electrostatic latent image is referred to as a BK latent image. Similarly, electrostatic latent images corresponding to yellow, magenta and cyan color images are referred to as a Y latent image, a M latent image and a C latent image, respectively.

In order that the tip of the BK latent image is developed with the BK developer, the developing sleeve 12 of the black developing device 431 is rotated to develop the BK latent image before the tip of the BK latent image reaches the developing position. The BK developing device continues the developing operation until the rear end of the BK latent image passes the developing position to form a black toner image on the photoreceptor drum 100. Then the revolver developing unit 430 is rotated so that the magenta developing device 434 achieves the developing position. This rotation is completed before the tip of the M latent image reaches the developing position.

When the image forming operation is started, the photoreceptor drum 100 and an intermediate transfer belt 319 serving as a toner image transporter are synchronously rotated. The BK toner image formed on the photoreceptor drum 100 is transferred onto the intermediate transfer belt 319 by a transfer roller 320. Similarly, an M toner image, a C toner image and a Y toner image, which have been sequentially formed on the photoreceptor drum 100, are transferred to proper positions of the intermediate transfer belt 319. Thus, a full color toner image is formed on the intermediate transfer belt 319.

On the other hand, a receiving paper is fed from a paper cassette in a paper bank 403, a manual paper tray or the like paper feeding section. The receiving paper is then stopped once at a nip between a pair of registration rollers. Then a transfer belt 322 is brought into contact with the intermediate transfer belt 319. The receiving paper is fed by the pair of registration rollers such that the full color toner image (i.e., four color toner images) is transferred to a proper position of the receiving paper by a transfer roller 323 at a nip between the transfer belt 319 and the transfer belt 322. Then the receiving paper is separated from the transfer belt 322 and is fed to a fixing device 328. The toner image on the receiving paper is fixed thereto by a pair of fixing rollers of the fixing device 328. Then the receiving paper (i.e., a copy) is discharged from a main body 300 of the image forming apparatus 200.

On the other hand, toner particles remaining on the surface of the photoreceptor 100 even after the first image transfer operation are removed by a photoreceptor cleaning unit 310. Toner particles remaining on the surface of the intermediate transfer belt 319 even after the second image transfer operation are removed by a belt cleaning unit 321.

When plural copies are produced, the same image forming operations are repeated. Namely, after the fourth color image (magenta color image, in this case) for the first copy has been formed on the photoreceptor 100, formation of the first color image (black color image, in this case) for the second copy on the photoreceptor drum 100 is started at a predetermined time. In addition, after the four color images for the first copy formed on the intermediate transfer belt 319 are transferred to the receiving paper, the surface of the intermediate transfer belt 319 is cleaned. Then the first color image of the second copy is transferred to the cleaned surface of the intermediate transfer belt 319. Further, the second, third and fourth color images are also transferred on the surface of the intermediate transfer belt 319 similarly to the first copy.

The above-mentioned copying operation is the four color image forming operation (i.e., full color image forming operation). When three color image formation or two color image formation is performed, the above-mentioned image forming operation is performed for the corresponding color images.

When monochrome image formation is performed, only the corresponding developing device in the revolver developing unit 430 is activated until the desired number of copies are produced. In this case, the copying operation is performed while a belt cleaning unit 321 is contacted with the intermediate transfer belt 319.

The photoreceptor drum 100 has a surface having a friction coefficient of from 0.10 to 0.30. In order to impart such a friction coefficient to the photoreceptor 100, for example, one or more of the following methods can be used:

(1) A lubricant is applied to the surface of the photoreceptor drum 100 by a lubricant applicator;

(2) A particulate lubricant is included in the outermost layer of the photoreceptor; and (3) A toner including a lubricant is used for developing electrostatic latent images.

The surface of the intermediate transfer belt 319 preferably has a friction coefficient not less than that of the photoreceptor drum 100. The intermediate transfer belt 319 preferably has a friction coefficient not greater than 0.55.

Figure 9:
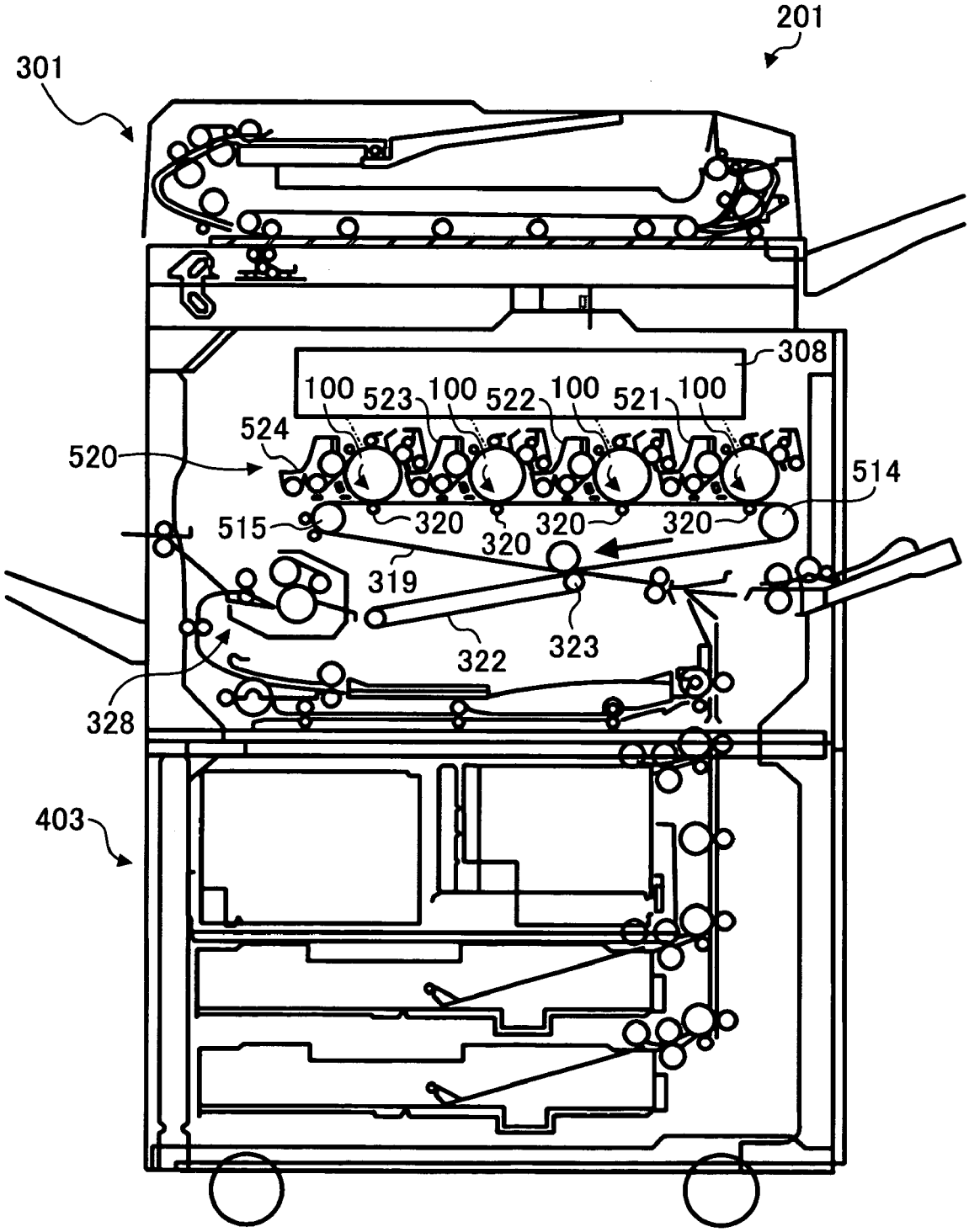
FIG. 9 is a schematic view illustrating a tandem full color printer/copier having an intermediate transfer medium, which is an embodiment of the image forming apparatus of the present invention.

FIG. 9 is a schematic view illustrating a tandem type image forming apparatus, which is one embodiment of the image forming apparatus of the present invention. The image forming apparatus has a plurality of image forming sections. In FIGS. 8 and 9, like reference characters designate like corresponding parts, and only the different parts will be mainly explained.

Above the intermediate transfer medium 319 which is tightly stretched with first and second support rollers 514 and 515, a tandem image forming section 520 are arranged side by side. The tandem image forming section 520 includes four photoreceptor drums 100; four charging rollers; black, yellow, cyan and magenta developing devices 521, 522, 523 and 524; four cleaning devices, etc.

When an image forming operation is started, the photoreceptors 100 and the intermediate transfer belt 319 are synchronously rotated. Similarly to the image forming operations of the image forming apparatus mentioned above, black, yellow, cyan and magenta toner images are formed on the respective photoreceptor drums 100. The four color toner images are sequentially transferred to proper positions of the intermediate transfer belt 319 (i.e., first image transfer) by the respective first transfer rollers 320. On the other hand, a receiving paper is fed from the paper bank 403, the manual paper tray or the like and is stopped once by registration rollers. The receiving paper is timely fed by the registration rollers while the transfer belt 322 is contacted with the intermediate transfer belt 319 so that the four color toner images on the intermediate transfer belt 319 are transferred at the same time to a proper position of the receiving paper (second image transfer) at the nip between the transfer belt 322 and the intermediate transfer belt 319.

The receiving paper on which the toner images are transferred is separated from the transfer belt 322 and is fed toward the fixing device 328. Then the toner images are fused and fixed to the receiving paper at the nip between the fixing rollers.

Toner particles remaining on the surface of the photoreceptors 100 even after the first image transfer operation are removed by photoreceptor cleaning units. Toner particles remaining on the surface of the intermediate transfer belt 319 even after the second image transfer operation are removed by a belt cleaning unit.

The photoreceptor drums 100 have a surface having a friction coefficient of from 0.10 to 0.30. In addition, the surface of the intermediate transfer belt 319 preferably has a friction coefficient not less than that of the photoreceptor drums 100. The intermediate transfer belt 319 preferably has a friction coefficient not greater than 0.55.

Figure 10:
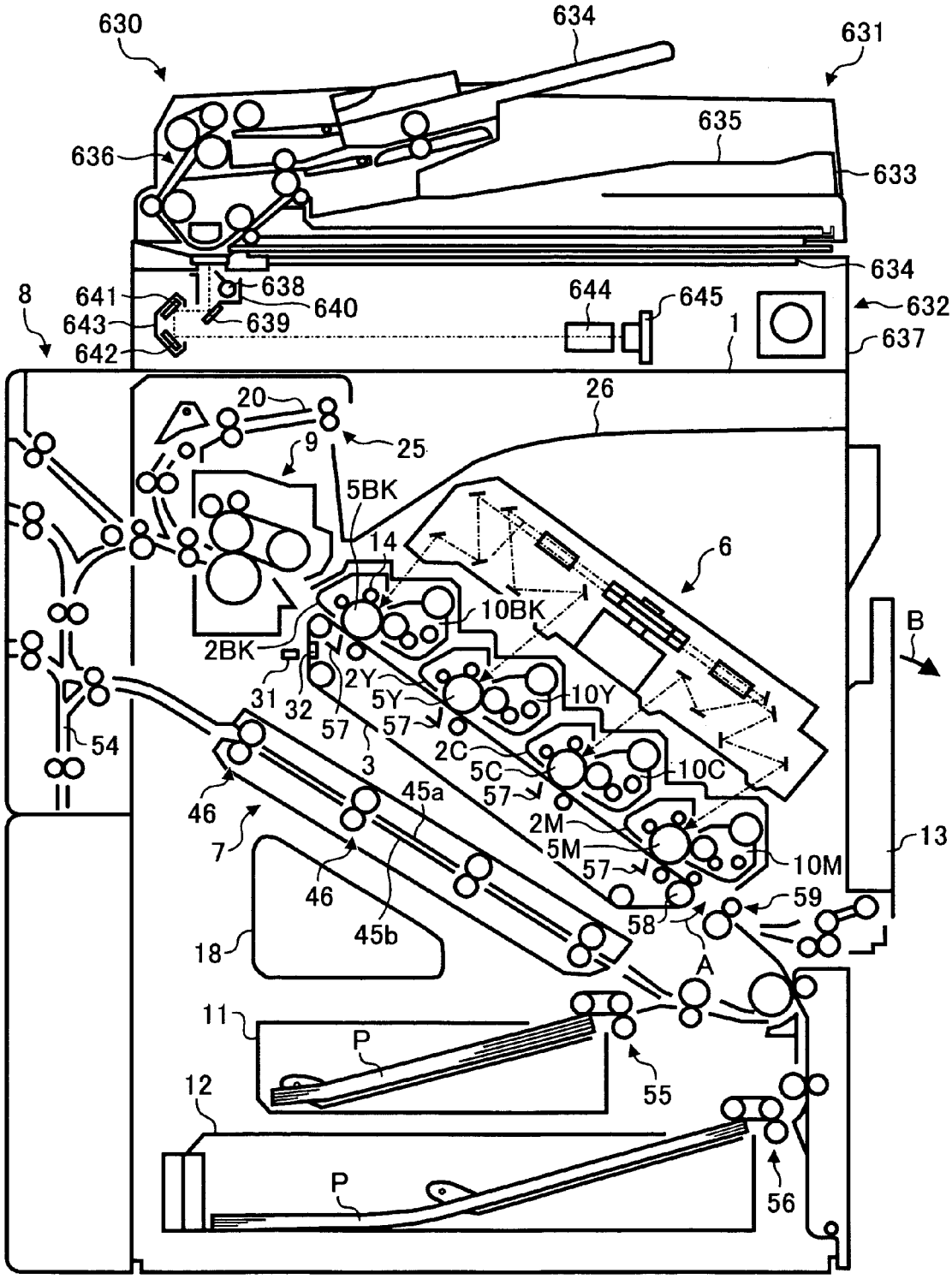
FIG. 10 is a schematic view illustrating another embodiment of the image forming apparatus of the present invention.

Then a full color copier which is an embodiment of the image forming apparatus will be explained referring to FIG. 10. A full color copier 630 has an image reader 631 and an image forming apparatus 1. Since the image forming apparatus 1 is explained above, only the image reader 631 will be explained here. The image reader 631 includes a scanner unit 632 and an automatic document feeder (ADF) 633 located above the scanner unit 632. The ADF 633 feeds an original document set on an original setting table 634 to a contact glass 634. In addition, the original whose image has been read is discharged to a tray 635 by an original feeding mechanism 636.

The contact glass 634 is arranged on a casing 637 of the scanner unit 632. Below the contact glass 634, a first scanner 640 including a lamp 638 and a mirror 639, and a second scanner 643 including mirrors 641 and 642 are arranged. The first and second scanners 640 and 643 can be moved in the sub-scanning direction in a speed ratio of 2/1. A focusing lens 644 and a color CCD 645 are arranged in the light path of the light reflected from the mirrors 639, 641 and 642.

The image forming apparatus 1 of the copier 630 performs image forming operation according to the thus read original image data.

EFFECTS OF THE INVENTION

As mentioned above, the photoreceptor of the present invention has a surface having a friction coefficient of from 0.10 to 0.30 by applying a lubricant to the surface. Since the surface includes a particulate metal oxide, the photoreceptor has good abrasion resistance. In addition, a gap is formed between the surface of the charging member and the surface of the photoreceptor by contacting the gap forming member with the non-image portions of the photoreceptor. Therefore a problem in that the toner particles remaining on the surface of the photoreceptor adhere to the charging member, thereby causing uneven charging, can be prevented.

Since the image forming apparatus has such a constitution, the friction coefficient of the surface of the photoreceptor can be maintained even when products such as ozone generated by discharging occurring between the charging member and the photoreceptor change the properties of the surface of the photoreceptor. As a result, the transferability of toner images can be improved, resulting in formation of high quality images.

Alternatively, the photoreceptor may have an outermost layer including a particulate lubricant such that the surface thereof have a friction coefficient of from 0.10 to 0.30. In this case, the friction coefficient can be maintained even when products such as ozone generated by discharging occurring between the charging member and the photoreceptor change the properties of the surface of the photoreceptor.

When the particulate lubricant included in the outermost layer is a material selected from the group consisting of fluorine-containing resins, silicone resins, and polyolefin resins, the charge properties of the photoreceptor are hardly deteriorated even if the added amount is large.

The content of the particulate lubricant in the outermost layer is preferably from 30 to 80% by weight while the thickness of the outermost layer is controlled so as to be from 4 to 10 μm. In this case, the surface of the photoreceptor can maintain the preferable friction coefficient without becoming brittle. Therefore, the photoreceptor has a long life while maintaining good charge properties.

The particulate lubricant is preferably present in the outermost layer in an area ratio not less than 10% to impart the preferable friction coefficient to the photoreceptor.

The particulate lubricant is preferably present in the outermost layer in an amount not less than 20% by volume based on the total volume of the outermost layer, to impart the preferable friction coefficient to the photoreceptor.

In the image forming apparatus of the present invention, a reflection type sensor is arranged at a position facing the transfer belt to check the amount of the reference pattern toner image formed thereon and the position of the reference toner image. The image forming conditions are controlled according to the results of the check.

Since the photoreceptor has a specific friction coefficient and the transfer medium (i.e., a toner image transporter) has a friction coefficient not less than that of the photoreceptor, a good reference toner image without omissions can be formed. By checking such a good reference toner image, the positions of color toner images can be precisely determined and thereby occurrence of misalignment of color toner images can be prevented.

In the image forming apparatus, the friction coefficient of the surface of the intermediate transfer belt (i.e., a toner image transporter) is preferably not less than that of the surface of the photoreceptor so that the toner images on the photoreceptor are well transferred to the intermediate transfer belt. Since the reference toner image can also be well transferred on the intermediate transfer medium, the positions of color toner images formed on the intermediate transfer belt can be precisely determined and thereby occurrence of misalignment of color toner images can be prevented.

The toner for use in the image forming apparatus of the present invention preferably has toner form factors SF-1 and SF-2 of from 100 to 180, a volume average particle diameter (Dv) of from 3 to 7 μm, and a ratio (Dv/Dn) of the volume average particle diameter (Dv) to the number average particle diameter (Dn) of from 1.00 to 1.40. In this case, the toner has uniform charge quantity, and thereby high quality images without background fouling can be produced. In addition, when the toner is used for an electrostatic transfer method, the transfer rate of toner images can be improved.

The toner is preferably prepared by a method including the steps of dispersing toner constituents including a polyester prepolymer having a functional group including a nitrogen atom, a polyester resin, a colorant and a release agent in an organic solvent to prepare a toner constituent liquid; dispersing the toner constituent liquid in an aqueous medium; reacting the toner constituent liquid to a crosslinking reaction and/or an extension reaction. Therefore, the toner has a small particle diameter and a sharp particle diameter distribution, and thereby high quality images can be produced.

The content of the particulate metal oxide in the outermost layer is preferably from 5 to 40% by weight, and the thickness of the outermost layer is preferably from 3 to 8 μm. Therefore, a photoreceptor having high sensitivity, good durability and good productivity can be produced.

When the Lubricant applied to the surface of the photoreceptor is fatty acid metal salts, the developer is hardly deteriorated even when the lubricant is mixed with the developer. In addition, when a fatty acid is included in the toner, the lubricant can be applied to the surface of the photoreceptor by both of the cleaning brush and the toner and thereby the surface of the photoreceptor can maintain the desired friction coefficient even when the image area proportion of images produced varies.

The AC bias applied to the charging roller preferably has a frequency of from 7 times to 12 times that of the linear speed of the photoreceptor. In this case, problems such as occurrence of stripe-form uneven charging and formation of toner film on the photoreceptor can be avoided.

The charging member of the charging roller is preferably made of a resin material and the gap forming member is made of an insulating resin material. In this case, resin materials have better cutting property than those using a rubber, and thereby the members can be formed with high precision. In addition, even when environmental conditions change, resin materials have better stability in size and hardness than rubbers, and thereby the desired gap can be stably maintained.

The process cartridge of the present invention includes a photoreceptor, a charging roller configured to charge the photoreceptor, and a cleaner configured to clean the surface of the photoreceptor while applying a lubricant to the surface of the photoreceptor. Therefore the lubricant can be periodically replaced with new one and the gap can be controlled so as to fall in a proper range.

In the image forming apparatus, it is unnecessary to apply a powder to the cleaning blade, which is conventionally applied to reduce the friction between the cleaning blade and the photoreceptor, resulting in prevention of the cleaning blade from reversing. However, in the image forming apparatus of the present invention the friction coefficient of surface of the photoreceptor is reduced, and therefore it is unnecessary to apply a powder to the cleaning blade. Accordingly a problem in that the powder scatters during transportation of the image forming apparatus and adheres to the charging device, resulting in occurrence of uneven charging and formation of undesired images.

This document claims priority and contains subject matter related to Japanese Patent Applications Nos. 2003-307090, 2003-358850 and 2003-373030, filed on Aug. 29, 2003, Oct. 20, 2003 and Oct. 31, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30;

wherein the toner has a volume average particle diameter (Dv) of from 3 to 7 μm, a ratio (Dv/Dn) of the volume average particle diameter (Dv) to a number average particle diameter (Dn) of from 1.00 to 1.40, a form factor SF-1 of from 100 to 180 and another form factor SF-2 of from 100 to 180 wherein said at least one image bearing member comprises an image bearing member which has an outermost layer with a thickness of from 3 to 8 μm and which comprises a metal oxide in an amount of from 5 to 40% by weight based on total weight of the outermost layer.

2. The image forming apparatus according to claim 1, further comprising:

a lubricant applicator configured to apply a lubricant to the surface of said at least one image bearing member.

3. The image forming apparatus according to claim 2, wherein the lubricant comprises a fatty acid metal salt.

4. The image forming apparatus according to claim 1, wherein the toner is prepared by a method comprising the steps of:

dissolving or dispersing toner constituents comprising a polyester prepolymer having a functional group including a nitrogen atom, a polyester resin, a colorant and a release agent in an organic solvent to prepare a toner constituent liquid; and dispersing the toner constituent liquid in an aqueous medium to subject the toner constituent liquid to at least one of a crosslinking reaction and an extending reaction.

5. The image forming apparatus according to claim 1, wherein the toner comprises a fatty acid metal salt.

6. The image forming apparatus according to claim 1, wherein at least one of said plurality of image bearing members comprises an outermost layer including a lubricant.

7. The image forming apparatus according to claim 6, wherein the lubricant comprises a material selected from the group consisting of particulate fluorine-containing resins, particulate silicone resins and particulate polyolefin resins.

8. The image forming apparatus according to claim 1 wherein said at least one image bearing member comprises a plurality of image bearing members.

9. An image forming apparatus comprising:

at least one image bearing member;

at least one charging device configured to charge a surface of the at least one image bearing member;

at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30;

a toner image transporter configured to receive the toner image from the at least one image bearing member to transport the toner image; and a toner image detector configured to evaluate the toner image on the toner image transporter;

wherein the toner image transporter has a surface having a coefficient of static friction not less than that of the surface of the at least one image bearing member.

10. The image forming apparatus according to claim 9, wherein the coefficient of static friction of the surface of the toner image transporter is not greater than 0.55.

11. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30, and wherein the charging device charges the at least one image bearing member by applying a DC bias with which an AC bias overlaps while a gap of from 10 to 80 μm is formed between the charging device and the at least one image bearing member, and wherein the AC bias has a peak-to-peak voltage not less than twice a voltage at which discharging starts to occur between the charging device and the image bearing member and a frequency of from 7 to 12 times a linear velocity of the at least one image bearing member.

12. An image forming apparatus comprising:

at least one image bearing member;

at least one charging device configured to charge a surface of the at least one image bearing member;

at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30;

a lubricant applicator configured to apply a lubricant to the surface of the at least one image bearing member;

a lubricant application controller configured to control the lubricant applicator so as to apply the lubricant to the at least one image bearing member at a time when the charging device and the developing device are not operated while the at least one image bearing member is rotated;

at least one bias applicator configured to apply a bias to the lubricant applicator; and at least one bias controller configured to control the bias application operation in such a way that the bias applied to the lubricant applicator in an image forming operation is different from that in a lubricant applying operation.

13. The image forming apparatus according to claim 12, wherein the bias applied to the lubricant applicator in the image forming operation has a polarity opposite to that of a charge of the toner, and the bias applied to the lubricant applicator in the lubricant application operation has one of an opposite polarity or and a zero polarity.

14. The image forming apparatus according to claim 12, including a plurality of image bearing members, a plurality of lubricant applicators and a plurality of lubricant application controllers corresponding to the plurality of image bearing members, wherein the image forming apparatus further comprises:

a lubricant application determining device configured to determine whether the lubricant application operation is performed for each image bearing member by the corresponding lubricant applicator.

15. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30;

wherein the toner has a volume average particle diameter (Dv) of from 3 to 7 μm, a ratio (Dv/Dn) of the volume average particle diameter (Dv) to a number average particle diameter (Dn) of from 1.00 to 1.40, a form factor SF-1 of from 100 to 180 and another form factor SF-2 of from 100 to 180;

at least one of said plurality of image bearing members comprises an outermost layer including a lubricant;

the outermost layer of the at least one image bearing member has a thickness of from 4 to 10 μm, and the lubricant is included in the outermost layer in an amount of from 30 to 80% by weight based on total weight of the outermost layer, and wherein said at least one image bearing member comprises an image bearing member which has an outermost layer with a thickness of from 3 to 8 μm and which comprises a metal oxide in an amount of from 5 to 40% by weight based on total weight of the outermost layer.

16. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30; and wherein the toner has a volume average particle diameter (Dv) of from 3 to 7 μm, a ratio (Dv/Dn) of the volume average particle diameter (Dv) to a number average particle diameter (Dn) of from 1.00 to 1.40, a form factor SF-1 of from 100 to 180 and another form factor SF-2 of from 100 to 180;

at least one of said plurality of image bearing members comprises an outermost layer including a lubricant, and wherein an area of the surface of the outermost layer occupied by the lubricant is not less than 10% based on a total surface area of the outermost layer.

17. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30;

wherein the toner has a volume average particle diameter (Dv) of from 3 to 7 μm, a ratio (Dv/Dn) of the volume average particle diameter (Dv) to a number average particle diameter (Dn) of from 1.00 to 1.40, a form factor SF-1 of from 100 to 180 and another form factor SF-2 of from 100 to 180;

wherein at least one of said plurality of image bearing members comprises an outermost layer including a lubricant and, wherein the lubricant is included in the outermost layer in an amount not less than 20% by volume based on a total volume of the outermost layer.

18. An image forming apparatus comprising:

at least one image bearing member;

at least one charging device configured to charge a surface of the at least one image bearing member; and at least one developing device configured to develop an electrostatic latent image on the surface of the at least one image bearing member with a developer including a toner to form a toner image thereon, wherein the surface of the at least one image bearing member has a coefficient of static friction of from 0.10 to 0.30, and wherein said at least one image bearing member comprises a plurality of image bearing members;

wherein the toner is prepared by a method comprising the steps of:

dissolving or dispersing toner constituents comprising a polyester prepolymer having a functional group including a nitrogen atom, a polyester resin, a colorant and a release agent in an organic solvent to prepare a toner constituent liquid;

dispersing the toner constituent liquid in an aqueous medium to subject the toner constituent liquid to at least one of a crosslinking reaction and an extending reaction; and wherein said at least one image bearing member comprises an image bearing member which has an outermost layer with a thickness of from 3 to 8 μm and which comprises a metal oxide in an amount of from 5 to 40% by weight based on total weight of the outermost layer.

* * * * *